US006070670A

United States Patent [19]

Carter et al.

[11] Patent Number: 6,070,670

[45] Date of Patent: Jun. 6, 2000

[54] MOVEMENT CONTROL SYSTEM FOR WELLBORE APPARATUS AND METHOD OF CONTROLLING A WELLBORE TOOL

[75] Inventors: Thurman B. Carter; Michael Luke, both of Houston; John D. Roberts, Spring, all of Tex.

[73] Assignee: Weatherford/Lamb, Inc., Houston, Tex.

[21] Appl. No.: 09/053,588

[22] Filed: Apr. 1, 1998

Related U.S. Application Data

[63] Continuation-in-part of application No. 08/846,456, May 1, 1997.

[51] Int. Cl.[7] ..... E21B 17/07; E21B 29/00

[52] U.S. Cl. ..... 166/381; 166/242.7; 166/355; 175/321

[58] Field of Search ..... 166/332.4, 332.6, 166/323, 355, 363, 381, 242.7, 324; 175/321; 137/155

[56] References Cited

U.S. PATENT DOCUMENTS

| | | | |
|---|---|---|---|
| 1,498,691 | 6/1924 | Kearns | 294/82.16 |
| 1,619,728 | 3/1927 | Hopkins | 175/325.2 |
| 1,660,033 | 2/1928 | Braswell | 464/18 |

(List continued on next page.)

FOREIGN PATENT DOCUMENTS

| | | |
|---|---|---|
| 85 304072 | 10/1985 | European Pat. Off. . |
| PCT/GB80/ 00196 | 11/1980 | WIPO . |

OTHER PUBLICATIONS

PCT Int'l Search Report, PCT/GB98/01127, counterpart of parent of this case.
OG Jul. 14, 1998 entry for U.S. Pat. No. 5,778,981.
OG Aug. 19, 1997 entry for U.S. Pat. No. 5,657,823.
OG Jan. 7, 1997 entry for U.S. Pat. No. 5,590,714.
Completion Solutions From TIW, 1990–91 Gen Catalog.
Single Joint Pick Up Cylinder, Frank's Intl'l 1993.
General Catalog 1974–1975, A–2 International, pp. 178, 179, 1974.

*Primary Examiner*—Eileen Dunn Lillis
*Assistant Examiner*—Chong S. Cho
*Attorney, Agent, or Firm*—Guy McClung

[57] ABSTRACT

A wellbore motion control apparatus for controlling the motion of a tubular wellbore string (in one aspect with an additional item and/or apparatus connected thereto) in a wellbore extending from a surface down into the earth has been invented which has, in one aspect, a central mandrel connected to the tubular wellbore string, a housing with a hollow interior and fluid therein, at least one fluid passage apparatus disposable in the hollow interior and having a fluid flow channel extending therethrough, and the at least one fluid passage apparatus secured to the central mandrel, the housing surrounding the central mandrel, the at least one fluid passage apparatus disposed for movement in a chamber defined by an inner surface of the housing and an outer surface of the central mandrel, the at least one fluid passage apparatus positioned within the chamber so that fluid therein is flowable therethrough permitting movement of the fluid passage apparatus within the chamber and thereby controlling movement of the mandrel and therefore of the tubular wellbore string in the wellbore. In one aspect, the apparatus has a first upper piston and a second lower piston, each movably disposed in the chamber, the first upper piston secured to the central mandrel so the central mandrel moves with the first upper piston, each piston having a fluid passage apparatus, the first upper piston movable about at least one rod connected to the second lower piston so that the first upper piston is movable downwardly on the at least one rod as fluid passes therethrough to move to abut the second lower piston. In one aspect the pistons move at different rates.

25 Claims, 18 Drawing Sheets

U.S. PATENT DOCUMENTS

| | | | |
|---|---|---|---|
| 1,669,898 | 5/1928 | Chase | 166/211 |
| 1,686,945 | 10/1928 | Abercrombie | 464/18 |
| 1,785,559 | 12/1930 | Ponti | 175/321 |
| 2,054,255 | 9/1936 | Howard | 175/299 |
| 2,102,236 | 12/1937 | Johansen | 175/321 |
| 2,210,506 | 8/1940 | Smith | 464/163 |
| 2,240,519 | 5/1941 | Reed | 175/321 |
| 2,684,835 | 7/1954 | Moore | 175/321 |
| 2,712,435 | 7/1955 | Allen | 267/137 |
| 2,815,928 | 12/1957 | Bodine, Jr. | 175/56 |
| 2,835,474 | 5/1958 | O'Connor et al. | 175/299 |
| 2,894,793 | 7/1959 | Robinson | 137/155 |
| 2,929,610 | 3/1960 | Stratton | 166/356 |
| 2,937,007 | 5/1960 | Whittle | 175/94 |
| 2,991,635 | 7/1961 | Warren | 464/21 |
| 2,994,335 | 8/1961 | Dudley | 137/155 |
| 3,033,011 | 5/1962 | Garrett | 464/20 |
| 3,037,803 | 6/1962 | Phillips | 294/82.16 |
| 3,071,193 | 1/1963 | Raulins | 166/332.4 |
| 3,073,134 | 1/1963 | Mann | 464/18 |
| 3,090,443 | 5/1963 | Bostock | 166/322 |
| 3,099,918 | 8/1963 | Garrett | 464/20 |
| 3,100,538 | 8/1963 | Sanders | 166/237 |
| 3,122,902 | 3/1964 | Blair et al. | 464/21 |
| 3,156,106 | 11/1964 | Crane | 464/20 |
| 3,194,330 | 7/1965 | Ware et al. | 175/321 |
| 3,248,886 | 5/1966 | Blenkarn | 405/211 |
| 3,274,798 | 9/1966 | Wiggins, Jr. | 464/20 |
| 3,301,324 | 1/1967 | Smith | 166/355 |
| 3,311,173 | 3/1967 | Etal | 166/332.4 |
| 3,314,657 | 4/1967 | Prudhomme et al. | 366/165.2 |
| 3,323,327 | 6/1967 | Leathers et al. | 464/20 |
| 3,342,202 | 9/1967 | Etal | 137/155 |
| 3,354,950 | 11/1967 | Hyde | 166/336 |
| 3,378,072 | 4/1968 | Smith | 166/298 |
| 3,382,936 | 5/1968 | Galle | 175/321 |
| 3,513,911 | 5/1970 | Petersen | 166/348 |
| 3,516,703 | 6/1970 | Templeton | 294/86.17 |
| 3,570,598 | 3/1971 | Johnson | 166/178 |
| 3,606,297 | 9/1971 | Webb | 267/125 |
| 3,667,252 | 6/1972 | Nelson | 464/20 |
| 3,721,293 | 3/1973 | Ahlstone et al. | 166/355 |
| 3,746,329 | 7/1973 | Galle | 267/125 |
| 3,768,562 | 10/1973 | Baker | 166/289 |
| 3,807,428 | 4/1974 | Watkins et al. | 137/155 |
| 3,830,306 | 8/1974 | Brown | 166/53 |
| 3,835,924 | 9/1974 | Albers et al. | 166/341 |
| 3,917,006 | 11/1975 | Kellner | 175/5 |
| 3,941,190 | 3/1976 | Conover | 166/187 |
| 3,965,980 | 6/1976 | Williamson | 166/321 |
| 3,973,468 | 8/1976 | Russell, Jr. | 91/25 |
| 3,991,837 | 11/1976 | Crickmer | 175/27 |
| 4,055,338 | 10/1977 | Dyer | 267/125 |
| 4,067,405 | 1/1978 | Bassinger | 175/321 |
| 4,072,190 | 2/1978 | Raulins | 175/321 X |
| 4,139,994 | 2/1979 | Alther | 464/20 |
| 4,268,013 | 5/1981 | Khan | 254/392 |
| 4,273,372 | 6/1981 | Sheshtawy | 294/86.15 |
| 4,274,486 | 6/1981 | Fredd | 166/373 |
| 4,320,803 | 3/1982 | Manderscheid | 166/334.4 |
| 4,438,910 | 3/1984 | McFadden | 267/126 |
| 4,457,377 | 7/1984 | Burris, II | 166/332.4 |
| 4,466,487 | 8/1984 | Taylor, Jr. | 166/339 |
| 4,535,972 | 8/1985 | Millheim et al. | 254/277 |
| 4,540,159 | 9/1985 | Jordan | 254/228 |
| 4,664,205 | 5/1987 | Knighton et al. | 175/58 |
| 4,693,316 | 9/1987 | Ringgenberg et al. | 166/355 |
| 4,784,540 | 11/1988 | Underhaug | 409/140 |
| 4,880,059 | 11/1989 | Brandell et al. | 166/332.4 |
| 5,103,906 | 4/1992 | Schultz et al. | 166/264 |
| 5,224,558 | 7/1993 | Lee | 175/325.4 |
| 5,316,084 | 5/1994 | Murray et al. | 166/332.4 |
| 5,348,351 | 9/1994 | LaFleur et al. | 285/110 |
| 5,350,015 | 9/1994 | Hailey | 166/55.8 |
| 5,469,878 | 11/1995 | Pringle | 137/155 |
| 5,664,629 | 9/1997 | Maitland | 166/373 |
| 5,697,768 | 12/1997 | Mills | 417/365 |
| 5,806,611 | 9/1998 | VanDenSteen et al. | 175/27 |

22
44
84
80
98
97
96
95
90
99
106
9
9
139
184
182
196
193
197
198
183
195
188
104
192
104a
104
104b
181
169
189
100

From FIG.16A 422
432
400
433
423
500
536
542a
542
538
540
433
423
530
529
534
532
406
524
503
502
514
510
506
424
497
516
504
500
434
To FIG.16C From FIG.16B
424
434

400
425
435
500
425
435
497
404
480
414
482
416
486
435
To FIG.16D

MOVEMENT CONTROL SYSTEM FOR WELLBORE APPARATUS AND METHOD OF CONTROLLING A WELLBORE TOOL

RELATED APPLICATION

This is a continuation-in-part of pending U.S. application Ser. No. 08/846,456 filed May 1, 1997 entitled "Wellbore Tool Movement Control" which is co-owned with the present invention and which application is incorporated fully herein for all purposes.

BACKGROUND OF THE INVENTION

1. Field Of The Invention

This invention is directed to motion controllers and compensators for items used in wellbores; to such devices useful with downhole drilling and/or milling tools and to downhole milling assemblies with such a device; to such devices useful with tools in a wellbore extending down from the sea floor and tools with such a device; and methods of using such items.

2. Description of Related Art

In milling a tubular with a downhole mill, using too much weight on the mill and/or advancing the mill too quickly can result in inadequate milling, inefficient milling, and damage to the milling system and to the item to be milled.

When milling in an environment in which contact between a milling system and a tubular to be milled is interrupted and then the milling system is again thrust against the tubular to be milled, it is possible to severely damage the milling system with an abrupt intense impact against the tubular being milled. In offshore milling operations, a mill lifted away from a tubular being milled, e.g. by a swell at the water's surface that lifts a boat or barge from which the milling system is suspended, can be slammed back into the tubular being milled as the swell passes and the boat is effectively lowered.

There has long been a need for apparatus to effectively control the rate at which an item is lowered in a wellbore. There has long been a need for an apparatus to compensate for unwanted motion that raises a tool in a wellbore when the tool is intended to be advanced in a direction opposite to that of the unwanted motion. There has long been a need, recognized now by the present inventors, to control the rate of advance of a downhole mill in certain milling operations. There has long been a need, recognized now by the present inventors, to advance, in a controlled manner, a downhole mill that is intermittently lifted away from an item that is being milled.

SUMMARY OF THE PRESENT INVENTION

The present invention, in certain aspects, discloses a system for controlling the rate of lowering of an item in a wellbore; such a system in one aspect including a central tubular member or string to be lowered in a wellbore, in one aspect with another item, apparatus, mill or mill system connected thereto; at least one sleeve around the central tubular member and spaced apart therefrom; an exterior of the central tubular member and an interior of the sleeve defining a chamber with an enclosed volume therebetween contained a fluid; the central tubular member having affixed thereto and projecting therefrom into the enclosed volume one or more flow control members each with a fluid passageway therethrough, the fluid passageway sized for the controlled passage therethrough of fluid in the enclosed volume from one side of the flow control member to the other so that the central tubular member's movement is limited by and thereby controlled by the rate of movement of the flow control member within the enclosed volume; and the flow control member movably and sealingly mounted for up and down movement in the enclosed volume. In one aspect there is a free floating piston in the chamber with one or more flow controllers which permit the free floating piston to move down in the chamber at a first controlled rate and there is an upper piston movable on a rod, rods, or similar guide(s) connected to the free floating piston so that the upper piston is movable downwardly to contact the free floating piston, the upper piston having one or more flow controllers that permit it to move at a controlled second rate until it abuts the free floating piston. In one aspect the first rate differs from the second rate so that sequenced lowering of central tubular is effected with movement at different rates. In one particular aspect the upper piston moves relatively quickly and the lower piston moves relatively slowly, e.g. for milling.

In another aspect, such a system as discussed above has two enclosed volumes and at least two flow control assemblies, each with at least one flow control member in each enclosed volume. One flow control assembly controls an initial tool descent and the other controls a subsequent descent associated with an interruption between contact of the tool with a desired item. In one aspect the first flow control assembly provides for a controlled descent for initial tool/item contact and, in certain embodiments, takes tens of minutes or even hours to effect desired descent and contact. In one aspect, the second flow control assembly effects re-contact of a tool and the item relatively quickly, e.g. in seconds or in about a minute or minutes.

In another aspect, an expansion/contraction compensator is provided for each enclosed volume (one or more enclosed volumes) which includes a movable piston movably disposed in a chamber having a compressible fluid on one side of the piston while the other side is in fluid communication with the fluid in the enclosed volume. Pressure on the sleeve's exterior (e.g. by the hydrostatic head of fluid in a wellbore) pushes fluid from the enclosed volume into the chamber, moving the piston. The piston compresses the gas on the side opposite the moving fluid, allowing fluid excess to enter the chamber to accommodate the decrease in volume effected by the pressure on the sleeve. Upon the cessation of the pressure on the sleeve, the compressed fluid pushes on the piston, pushing the fluid from the chamber back into the enclosed volume.

In one aspect the system includes a tubular string of drill pipe and drill collars extending from a rig, and including a drill bit or a mill or mills attached at the bottom of the string for milling a tubular, e.g. a liner or casing, by rotation of the string, either from the surface or by a downhole motor. In one such system a sleeve assembly rests in and on a wellhead either at the earth's surface or on the sea floor. The sleeve assembly is stationary with respect to the wellhead while the central tubular member, attached in the tubular string is rotatable. To facilitate rotation, the sleeve assembly has a bottom that rolls and rotates on a lower bearing assembly and in a side bearing assembly.

In one aspect, roller bearings of the lower bearing assembly produce heat that expands lubricating fluid therearound. To compensate for this expansion, a chamber in fluid communication with the lubricating fluid has a free floating piston movably disposed therein with a compressible fluid on a piston side opposite to the side in contact with the lubricating fluid. As the lubricating fluid expands, the piston moves in the chamber, compressing the compressible fluid.

As the lubricating fluid cools, the compressed compressible fluid moves the piston back to its initial position.

Systems according to the present invention may be used to control the movement of a mill(s), a drill bit, or a mill-drill tool, e.g. as disclosed in the pending U.S. application entitled "Wellbore Milling-Drilling" filed on Apr. 2, 1997 and co-owned with the present invention, which application is incorporated fully herein for all purposes.

In one aspect, such a system has a first flow control assembly that initially lowers a mill to contact and mill a tubular to be milled at a controlled rate of advance and a second flow control assembly that re-lowers the mill to contact the tubular in the event the mill is inadvertently lifted away from the tubular. In one aspect the first control assembly takes about a half, one, two, five, ten or more hours to lower the mill and the second flow control assembly re-lowers the mill in about one, two, three, four, five, ten or more minutes.

In one system such as any system discussed above, one or both (or more if there are three, four or more) flow control assemblies has check valves therein which prevent fluid from flowing back through the flow control assembly. For example, in a system in which a first upper flow control assembly moves down about five feet in an enclosed volume and then the entire tubular string is raised, a check valve in the first upper flow control assembly that previously has allowed fluid to pass from a bottom side of the flow control assembly, through the flow control assembly, to a top side of the flow control assembly, now prevents fluid passage in the opposite direction (top to bottom). Thus the flow control assembly will not move back up in the enclosed volume and holds the central tubular member at the same location with respect to the sleeve until downward movement (fluid flow from bottom to top) of the flow control assembly again commences.

In one aspect the system is positioned in and as part of a tubular wellbore string, in one aspect a part between a boat and a wellhead at the seabed surface. In another aspect, the system—with either a solid central mandrel or a hollow one—is used in the cable system that supports the string.

In one aspect the enclosed volume is fillable with fluid at the surface; and/or re-fillable with fluid. In one aspect the sleeve(s) rotate with the central tubular member.

In certain embodiments, the present invention discloses a wellbore motion control apparatus for controlling the motion of a tubular wellbore string in a wellbore extending from a surface down into the earth, the motion control apparatus having a housing with a top end, a bottom end, and a hollow interior having an interior volume with fluid therein, at least one fluid passage apparatus having a top end and a bottom end and disposable in the hollow interior of the housing, the at least one fluid passage apparatus having a fluid flow channel extending therethrough from the top end to the bottom end, and the at least one fluid passage apparatus securable to a member of the tubular wellbore string while the at least one fluid passage apparatus is positioned within the hollow interior of the housing so that fluid in the hollow interior of the housing is flowable through the fluid flow channel from one end of the fluid passage apparatus to the other end of the fluid passage apparatus permitting movement of the fluid passage apparatus within the housing controlling movement of the member of the tubular wellbore string and thereby controlling movement of the tubular string in the wellbore; such an apparatus wherein the member of the tubular string is a mandrel with a top end and a bottom end, each end connectible to another member of the tubular string; such an apparatus wherein the mandrel has a fluid flow bore therethrough from the top end thereof to the bottom end thereof; such an apparatus wherein the bottom end of the housing has a bevelled edge for seating against a corresponding edge of a part of a wellhead; such an apparatus wherein the at least one fluid passage apparatus is at least two fluid passage apparatuses; such an apparatus wherein the fluid in the housing is liquid; such an apparatus wherein the fluid in the housing is gas; such an apparatus wherein the fluid flow channel is sized so that the fluid passage apparatus traverses the housing from one end thereof to the other end thereof in about an hour; such an apparatus wherein the fluid flow channel is sized so that the fluid passage apparatus traverses the housing from one end thereof to the other end thereof in about a minute; any such apparatus with a mandrel wherein the at least one fluid passage apparatus is secured to the mandrel; such a apparatus wherein the tubular wellbore string has a lower end and cutting apparatus attached at the lower end; such an apparatus including the cutting apparatus; such an apparatus wherein the cutting apparatus comprises tubular milling apparatus, drilling apparatus, mill-drill apparatus, or any combination thereof; any such apparatus with check valve apparatus in the fluid flow channel of the at least one fluid passage apparatus for permitting flow through the fluid flow channel from the bottom of the at least one fluid passage apparatus to the top thereof and out therefrom into space above the at least one fluid passage apparatus in the hollow interior of the housing, the check valve apparatus preventing fluid flow in the opposite direction from the space above the at least one fluid passage apparatus to a space below it in the hollow interior of the housing; any such apparatus with a bearing apparatus secured to the member of the tubular wellbore string, and the wellbore motion control apparatus having a bottom end resting on and rotatable on the bearing apparatus; any such apparatus wherein the bearing apparatus has a plurality of rollers rotatably mounted in a primary chamber therein, the primary chamber contains lubricant for lubricating the rollers, an expansion chamber is in fluid communication with the primary chamber, and a piston is movably disposed in the expansion chamber and biased downwardly by a spring in the expansion chamber above the piston, the piston movable upwardly in response to lubricant expanded by heating from the primary chamber; any such apparatus with an amount of compressible gas above the piston in the expansion chamber which gas is compressed as the piston moves up; any such apparatus with the housing having a selectively openable top port and a selectively openable bottom port for accessing the hollow interior of the housing to remove therefrom and to introduce thereinto fluid; any such apparatus with a housing chamber having a top and a bottom, and the housing's hollow interior in fluid communication with the housing chamber, a piston movably disposed in the housing chamber with an amount of gas above the piston in the housing chamber, the piston positioned for contact by the fluid in the housing's hollow interior so that compression of the housing by pressure of fluid external thereto moves the fluid in the hollow interior against the piston forcing it upwardly in the housing chamber and compressing the gas above the piston.

The present invention discloses, in certain aspects, a wellbore motion control apparatus for controlling the motion of a tubular wellbore string in a wellbore extending from a surface down into the earth, the motion control apparatus having as a first apparatus any apparatus for motion control described herein, and as a second apparatus any motion control apparatus described herein; any such apparatus wherein a fluid flow rate in the first apparatus is less than a flow rate in the second apparatus; any such apparatus wherein the first flow rate is such that the at least one first fluid passage apparatus in the first apparatus traverses a housing of the first apparatus from one end to the other end thereof in about an hour and wherein the flow rate for the second apparatus is such that a fluid passage apparatus in the second apparatus traverses a housing thereof from one end thereof to the other in about a minute; such an apparatus wherein check valve apparatus in the first fluid flow channel of the at least one first fluid passage apparatus for permitting flow through the first fluid flow channel from the bottom of the at least one first fluid passage apparatus to the top thereof and out therefrom into space above the at least one first fluid passage apparatus in the hollow interior of the first housing, the check valve apparatus preventing fluid flow in the opposite direction from the space above the at least one first fluid passage apparatus to a space below it in the hollow interior of the first housing.

The present invention discloses, in certain aspects a wellbore motion control apparatus for controlling the motion of a tubular wellbore string in a wellbore extending from a surface down into the earth, the motion control having a housing with a top end, a bottom end, and a hollow interior having an interior volume with fluid therein, a mandrel having a top end and a bottom end, the mandrel mounted for movement in the housing, at least one fluid passage apparatus having a top end and a bottom end and disposable in the hollow interior of the housing, the at least one fluid passage apparatus having a fluid flow channel extending therethrough from the top end to the bottom end, and the at least one fluid passage apparatus secured to the mandrel while the at least one fluid passage apparatus is positioned within the hollow interior of the housing so that fluid in the hollow interior of the housing is flowable through the fluid flow channel from one end of the fluid passage apparatus to the other end of the fluid passage apparatus permitting movement of the fluid passage apparatus within the housing thereby controlling movement of the mandrel; any such apparatus wherein the mandrel is solid.

The present invention discloses, in certain aspects a method for controlling the motion of a tubular string used in wellbore operations, the method including connecting a wellbore motion control apparatus in the tubular string, the wellbore motion control apparatus having a housing with a top end, a bottom end, and a hollow interior having an interior volume with fluid therein, at least one fluid passage apparatus having a top end and a bottom end and disposable in the hollow interior of the housing, the at least one fluid passage apparatus having a fluid flow channel extending therethrough from the top end to the bottom end, and the at least one fluid passage apparatus securable to a member of the tubular wellbore string while the at least one fluid passage apparatus is positioned within the hollow interior of the housing so that fluid in the hollow interior of the housing is flowable through the fluid flow channel from one end of the fluid passage apparatus to the other end of the fluid passage apparatus permitting movement of the fluid passage apparatus within the housing controlling movement of the member of the tubular wellbore string and thereby controlling movement of the tubular string in the wellbore; and flowing the fluid in the hollow interior of the housing from a space below the at least one fluid passage apparatus, through the at least one fluid passage apparatus, to a space above the at least one fluid passage apparatus as the at least one fluid passage apparatus moves down in the housing thereby controllably moving the tubular string down.

The present invention discloses, in certain aspects, a method for controlling the motion of an item (e.g. but not limited to a tubular, a tubular string, or any wellbore tool or device) used in wellbore operations, the method including connecting a wellbore motion control apparatus between the item and a rig support (e.g. but not limited between a support cable and the item or as a member of a tubular string; e.g. as a joint compensator) for the item, the wellbore motion control apparatus having a housing with a top end, a bottom end, and a hollow interior having an interior volume with fluid therein, a mandrel having a top end and a bottom end, the mandrel mounted for movement in the housing, at least one fluid passage apparatus having a top end and a bottom end and disposable in the hollow interior of the housing, the at least one fluid passage apparatus having a fluid flow channel extending therethrough from the top end to the bottom end, and the at least one fluid passage apparatus secured to the mandrel while the at least one fluid passage apparatus is positioned within the hollow interior of the housing so that fluid in the hollow interior of the housing is flowable through the fluid flow channel from one end of the fluid passage apparatus to the other end of the fluid passage apparatus permitting movement of the fluid passage apparatus within the housing thereby controlling movement of the mandrel, and flowing the fluid in the hollow interior of the housing from a space below the at least one fluid passage apparatus, through the at least one fluid passage apparatus, to a space above the at least one fluid passage apparatus as the at least one fluid passage apparatus moves down in the housing thereby controllably moving the item down. In one such method control apparatus may be provided for opening and closing fluid flow channel(s) in the fluid passage apparatus to control the movement of the at least one fluid passage apparatus thereby controlling movement of the item. Such control apparatus may be operable on the rig floor, adjacent the item, and/or remote therefrom. In one aspect the control apparatus opens and closes the fluid flow channel(s). In another aspect, the control apparatus controls the cross-sectional size of the fluid flow channel.

It is, therefore, an object of at least certain preferred embodiments of the present invention to provide:

New, useful, unique, efficient, nonobvious apparatuses and methods for controlling the motion up and down of an item in a wellbore;

Such apparatuses with two movable pistons mounted in a fluid chamber, each whose rate of movement is controlled by one or more flow controllers so that sequenced motion of a tubular and or attached item in a wellbore is achieved, in one aspect, with a relatively slow period of movement and with a relatively fast period of movement;

Such apparatuses and methods for controlling the descent of an item in a wellbore and, in one aspect, in a wellbore extending down from the seabed, and for known incremental distance advance;

Such apparatuses and methods for controlling the advance of an apparatus or device in a wellbore, including but not limited to the advance of a drill bit as it drills formation or of a mill system as it mills a tubular; and such apparatus useful in a cable system in a rig that supports a tubular wellbore string or within the string itself;

Such apparatus and methods for controllingly re-lowering a bit or mill when its contact with formation or a tubular is interrupted;

Such apparatus or methods including expansion/contraction compensation apparatus; and Such apparatus and methods for compensating for expanding lubrication fluid used in lubricating one or more bearings used in such apparatus and methods.

Certain embodiments of this invention are not limited to any particular individual feature disclosed here, but include combinations of them distinguished from the prior art in their structures and functions. Features of the invention have been broadly described so that the detailed descriptions that follow may be better understood, and in order that the contributions of this invention to the arts may be better appreciated. There are, of course, additional aspects of the invention described below and which may be included in the subject matter of the claims to this invention. Those skilled in the art who have the benefit of this invention, its teachings, and suggestions will appreciate that the conceptions of this disclosure may be used as a creative basis for designing other structures, methods and systems for carrying out and practicing the present invention. The claims of this invention are to be read to include any legally equivalent devices or methods which do not depart from the spirit and scope of the present invention.

The present invention recognizes and addresses the previously-mentioned problems and long-felt needs and provides a solution to those problems and a satisfactory meeting of those needs in its various possible embodiments and equivalents thereof. To one skilled in this art who has the benefits of this invention's realizations, teachings, disclosures, and suggestions, other purposes and advantages will be appreciated from the following description of preferred embodiments, given for the purpose of disclosure, when taken in conjunction with the accompanying drawings. The detail in these descriptions is not intended to thwart this patent's object to claim this invention no matter how others may later disguise it by variations in form or additions of further improvements.

DESCRIPTION OF THE DRAWINGS

A more particular description of embodiments of the invention briefly summarized above may be had by references to the embodiments which are shown in the drawings which form a part of this specification. These drawings illustrate certain preferred embodiments and are not to be used to improperly limit the scope of the invention which may have other equally effective or legally equivalent embodiments.

DESCRIPTION OF EMBODIMENTS PREFERRED AT THE TIME OF FILING FOR THIS PATENT

Figure 1A:
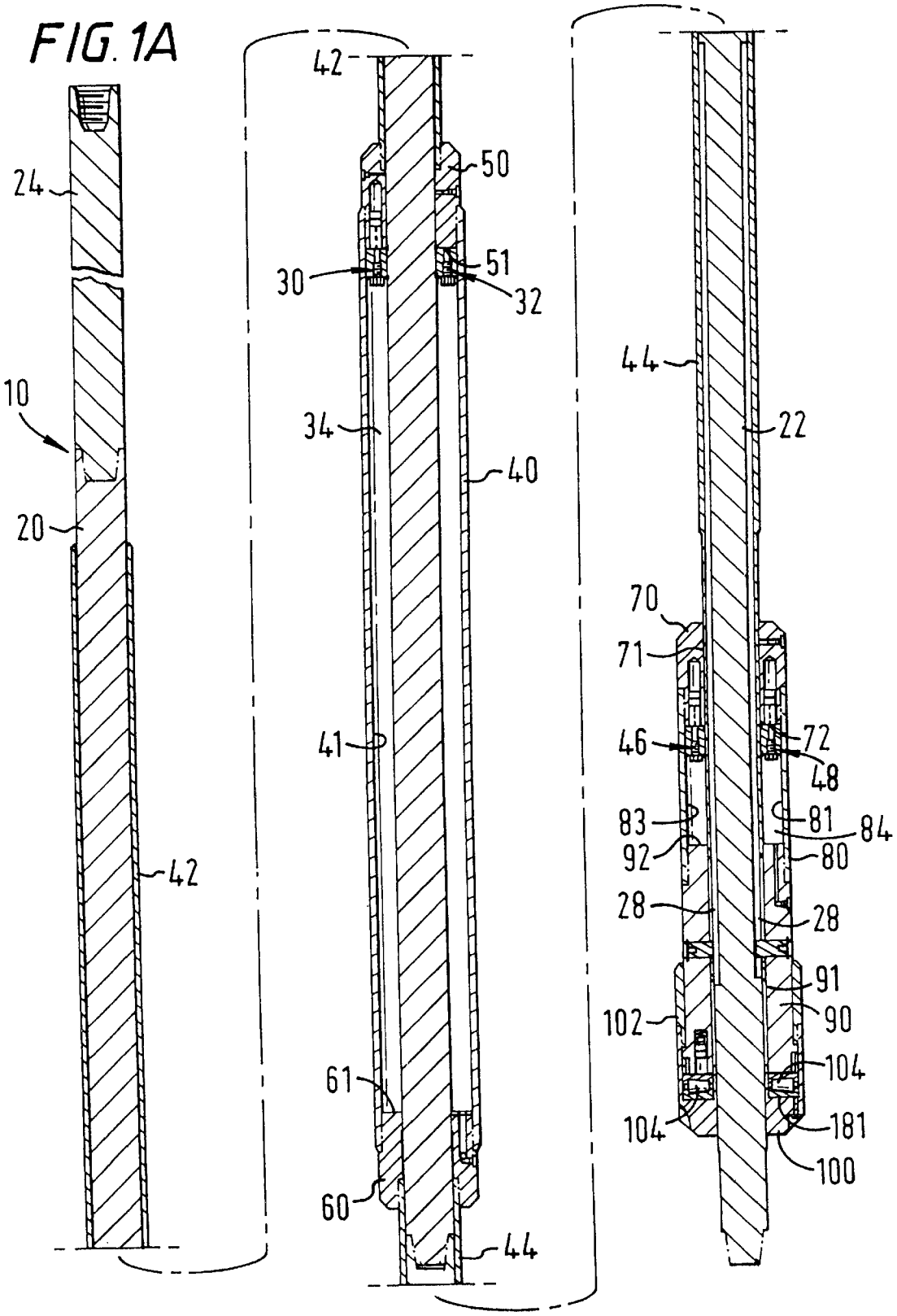
FIG. 1 is a side cross-section view of a system according to the present invention.
Figure 2:
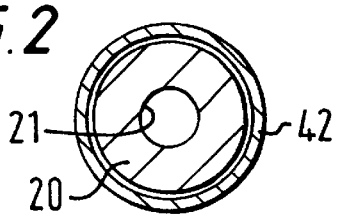
FIG. 2 is a cross-section view along line 2—2 of FIG. 1.
Figure 3:
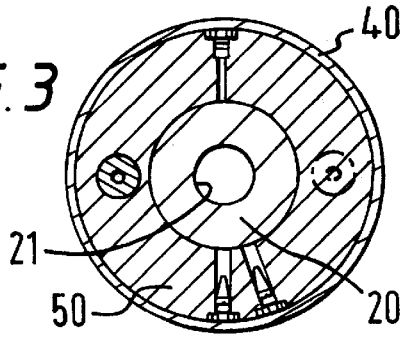
FIG. 3 is a cross-section view along line 3—3 of FIG. 1.
Figure 4:
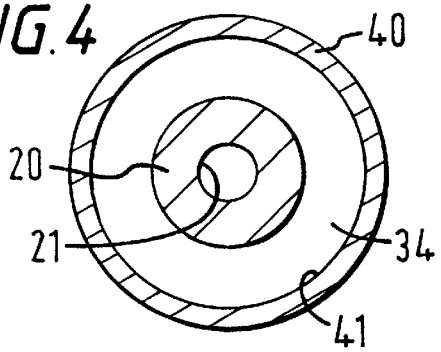
FIG. 4 is a cross-section view along line 4—4 of FIG. 1.
Figure 5:
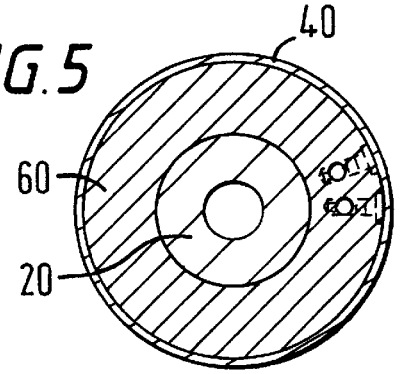
FIG. 5 is a cross-section view along line 5—5 of FIG. 1.
Figure 6:
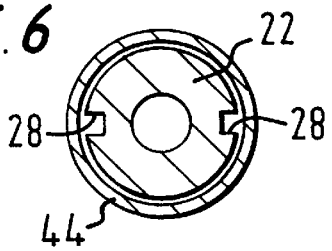
FIG. 6 is a cross-section view along line 6—6 of FIG. 1.
Figure 7:
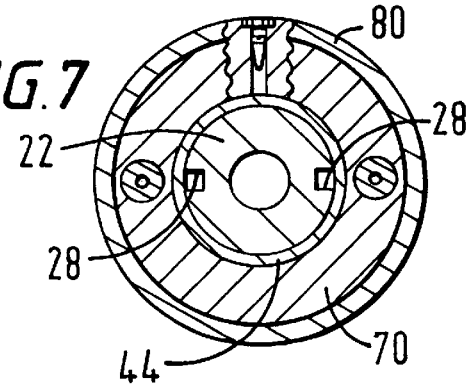
FIG. 7 is a cross-section view along line 7—7 of FIG. 1.
Figure 8:
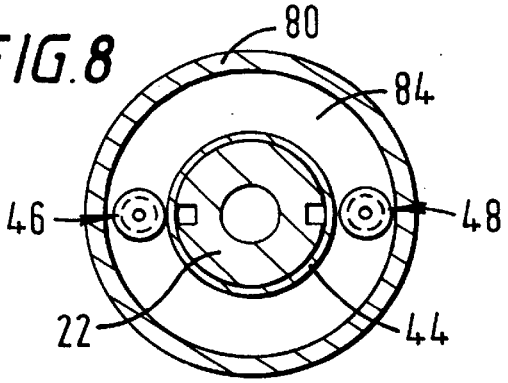
FIG. 8 is a cross-section view along line 8—8 of FIG. 1.
Figure 9:
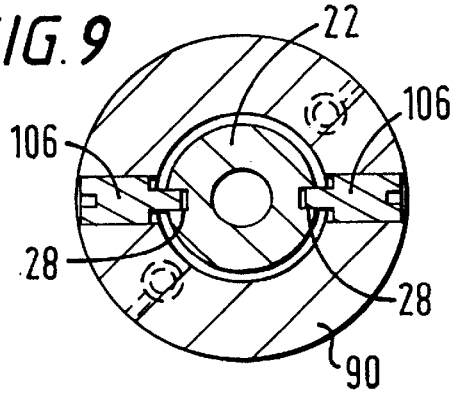
FIG. 9 is a cross-section view along line 9—9 of FIG. 1.

FIG. 1 shows a tool 10 according to the present invention that may be used in a tubular string to control the rate of advance or descent of the string and thus control the rate of advance or descent of another tool, device, or apparatus connected to or in the string. For example, and without limitation, the tool 10 may be used in a tubular string of tubing, casing, or pipe; it may be used with a mill or mills, with a drill bit, or with a mill-drill tool; and it may be used with a tubular string rotated by a rotary, by a downhole motor or both.

In one aspect the tool 10 includes an upper mandrel extension 24, an upper mandrel 20, threadedly connected to the upper mandrel extension 24, and a lower mandrel 22 threadedly connected to the upper mandrel 20. In the embodiment of the tool 10 shown, fluid flows through the tool 10 from top to bottom through a flow bore 25 through the mandrel extension 24, a flow bore 21 through the upper mandrel 20, and through a flow bore 21 through the lower mandrel 22. However one or more or all of the mandrel extension 24, upper mandrel 20 and lower mandrel 22 may be solid or they may be replaced by a single solid member. The tool 10 may be used within a tubular or tubulars or it may be used at a point in a tubular string outside of tubulars such as well casing; e.g. but not limited to, in a tubular string above a well-head on a sea floor or in a tubular string in a derrick.

The rate of descent or advance of the mandrel system (upper mandrel extension 24, upper mandrel 20, lower mandrel 22) is controlled by one or more flow control assemblies secured to the mandrel system and movable in fluid in one or more enclosed volumes of fluid formed around a portion of the mandrel system. Each flow control assembly has a part movable through an enclosed volume. The part is movable when fluid in the enclosed volume flows through an orifice, valve, opening, or flow control device in the flow control assembly. The orifice, opening, valve, or flow control device is sized so that the fluid moves at a certain rate through the flow control assembly and, thereby, the flow control assembly moves at a desired rate down through the enclosed volume. In turn the mandrel system, and hence the tubular string containing it, move down (or forward) at the controlled rate of movement of the flow control assemblies that are secured to the mandrel system. It is within the scope of this invention to use one flow control assembly in one enclosed volume; to use a plurality of flow control assemblies in a plurality of enclosed volumes; to use flow control assemblies with a first rate of movement in a first enclosed volume and additional flow control assemblies with different rates of movement in additional enclosed volumes; or to use one or more flow control assemblies in enclosed volume(s) to control the rate of movement of members defining another enclosed volume. The enclosed volumes contains liquid, e.g. hydraulic fluid, oil, ethylene glycol, water or any suitable clean liquid. In other aspects it contains a gas, e.g. air, nitrogen, or helium, or a mixture thereof.

The tool 10 as shown in FIG. 1 has two upper flow control assemblies 30 and 32 movably disposed in an enclosed volume 34 of fluid, e.g. but not limited to hydraulic fluid or oil. The enclosed volume 34 is defined generally by an interior surface 41 of a sleeve 40, a lower end 51 of an upper cap 50, and an upper end 61 of a lower cap 60. An upper sleeve 42 is secured to the upper cap 50 and the mandrel system is movable within the upper sleeve 42.

A top end of a middle sleeve 44 is secured to the lower cap 60 and a bottom end of the middle sleeve 44 is movably disposed in and through a bore 71 through a cylinder cap 70, a bore 81 of a lower housing 80, and a bore 91 of a body 90.

Flow control assemblies 46 and 48 are secured to the lower end of the middle sleeve 44 and are movable in an enclosed volume 84 of fluid, e.g. but not limited to hydraulic fluid or oil. The enclosed volume 84 is defined generally by a lower end 72 of the cylinder cap 70, an inner surface 83 of the lower housing 80 and an upper end 92 of the body 90.

When the flow control assemblies 46, 48 move in the enclosed volume 84, the middle sleeve 44, lower cap 60, sleeve 40, upper cap 50 and upper sleeve 42 move together.

A retainer sleeve 102 is secured to a bearing housing 100 and a lower portion of the body 90 is disposed within the retainer sleeve 102. A plurality of roller bearings 104 are rotatably mounted in a chamber 181 (in the bearing housing 100 so that both enclosed volumes 34 and 84 and the members defining them along with the sleeves 40, 42, and 44 are rotatable on the roller bearings 104 and are, therefore, rotatable with the mandrel system. One or more keys 106 extending through the body 90 extend into keyways 28 of the lower mandrel 22 so that as the mandrel 22 rotates the body 90 and items attached thereto rotate, including the lower sleeve 44). The retainer sleeve 102 (and items connected thereto) does not rotate.

Figure 10:
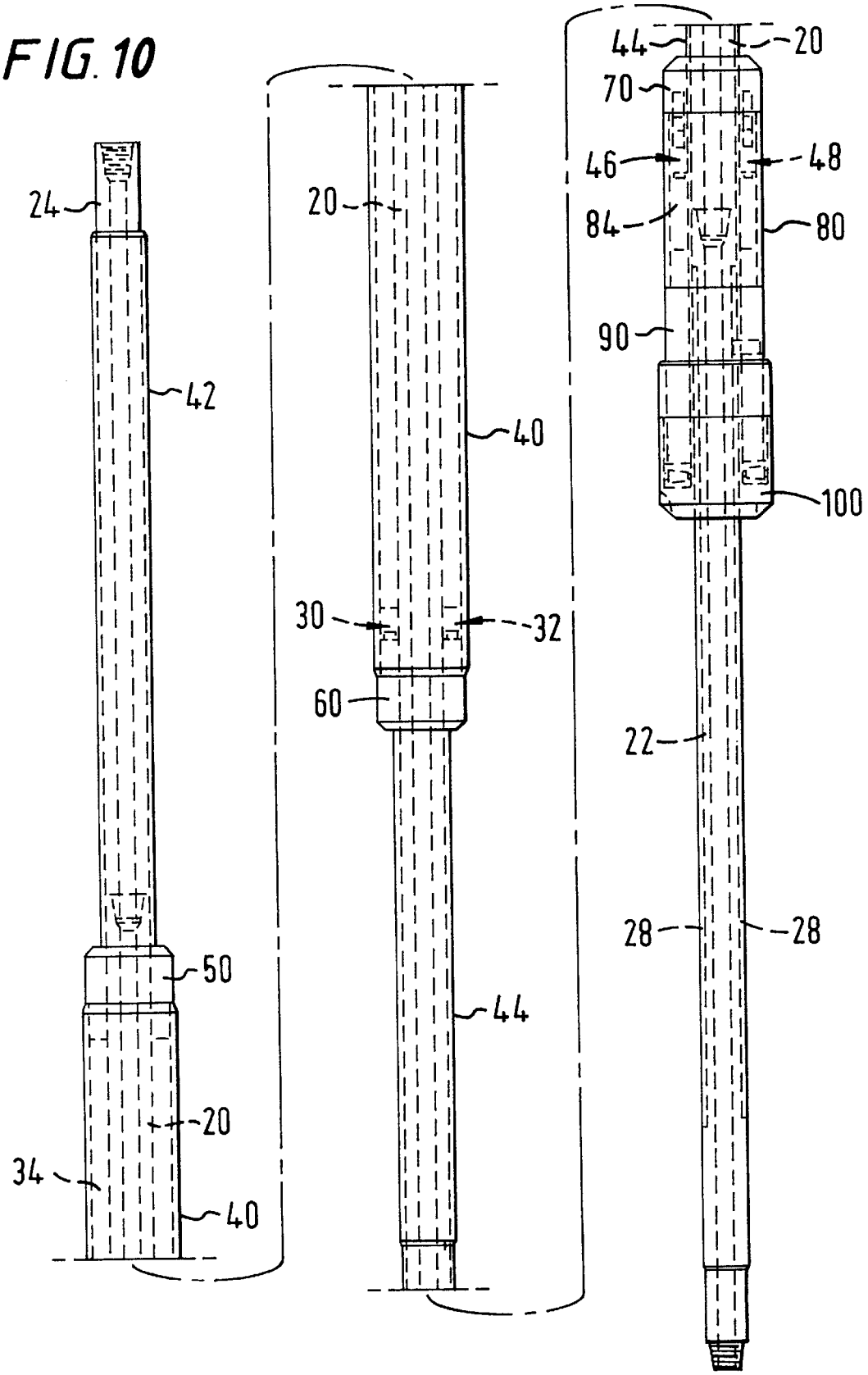
FIG. 10 is a side cross-section view of a system according to the present invention.

As shown in FIG. 10 the mandrel system has moved down to the extent of the enclosed volume 34 and the flow control assemblies 30, 32 have moved down from the top of the enclosed volume 34 to the bottom thereof.

Figure 12:
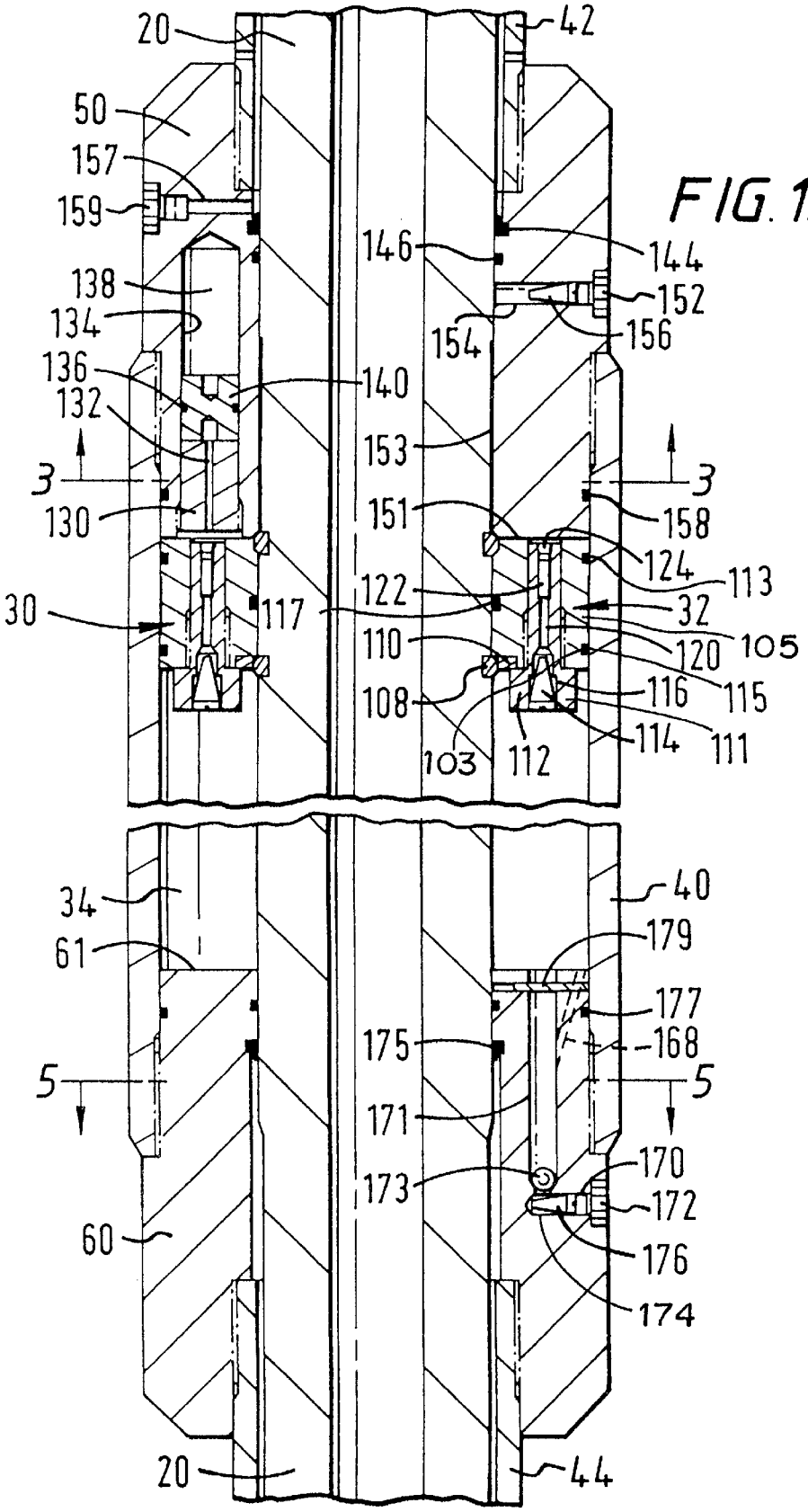
FIG. 12 shows an enlarged view of part of the system of FIG. 1.

FIG. 12 shows an enlargement of the upper cap 50 and the lower cap 60. The flow control assembly 32 includes a piston 111 whose interface with the sleeve interior surface 41 is sealed with o-rings 113, 115 and whose interface with the exterior of the mandrel is sealed with o-ring 117. Split locking rings 108 secure the flow control assembly 32 to the upper mandrel 20. A retainer ring 110 retains the top split locking ring 108 in place. A screen 114 for screening particles in the fluid and thereby preventing clogging of the flow control assembly is disposed in a bore 116 of a housing 112 in the piston 111. A controlled-size orifice device 120 is disposed in the bore 116 between the screen 114 and a relief valve assembly 122. A screen 124 is disposed above (to the left in FIG. 12) the relief valve assembly 122.

In one aspect the controlled-size orifice device 120 is a commercially available Flosert device sold by the Lee Company with an orifice sized to permit a flow therethrough of about 0.1 gallons per minute. One, two, three, four or more Floserts may be used. In one aspect the relief valve assembly includes two relief valves, one set at 200 p.s.i. and one set at 400 p.s.i. (to relieve fluid pressure inside the enclosed volume and control the rate of advance of the system). The flow control assembly 30 is like the flow control assembly 32.

In the event pressure external to the sleeve 40 pushes the sleeve in decreasing the volume of the enclosed volume 34, fluid from the compressed volume may flow through a bore 132 of a piston retainer 130 to contact and move a piston 140 movably disposed in a channel 134. On the other side of the piston 140 (to the left in FIG. 12) is an amount of a compressible fluid 138, (e.g., but not limited to gas, air, nitrogen, helium). A seal 136 seals the piston/upper cap interface. To the extent the enclosed volume 34 is decreased, the piston 140 moves, compressing the fluid 138. Fluid from the enclosed volume 34 may flow to the bore 132 directly from the enclosed volume 34 or through the flow control assemblies. A wiper 144 is secured to the upper cap 50 to wipe the mandrel's surface and to inhibit the passage of contaminants to the seal 146. An o-ring 146 seals the mandrel/upper cap interface. A plug 152 is removably disposed in a fill hole 154 through which fluid may be pumped to fill the enclosed volume 34. A screen 156 to filter incoming fluid is also disposed in the hole 154. A seal 158 seals the upper cap/sleeve interface. A plug 159 is removably emplaced in a wash port 157. The wash port 157 provides access to the enclosed volume, e.g. at the earth's surface to introduce fluid thereinto to reset the tool. Fluid flows through the fill hole 154, to and through a channel 153, and either into the enclosed volume 34 through a channel 151 and the flow control assembly or directly into the enclosed volume 34.

The lower cap 60 has a plug 172 removably emplaced in a channel 170 for filling fluid into the enclosed volume 34. A filtering screen 176 is placed in the channel 174. To prevent fluid from escaping from the enclosed volume 34 a ball 173 is movably disposed in a channel 171 which is in fluid communication with the channel 174 and with the enclosed volume 34. When the ball 173 is seated as shown in FIG. 12, fluid may not flow to the channel 174. A pin 179 holds the ball in the channel 171. An o-ring seal 177 seals the lower cap/sleeve interface. A wiper ring 175 is secured to the lower cap 60. A vent channel 168 is disposed so that during filling through the channel 174, (the ball 173 is moved against the pin 179 and fluid flows into the enclosed volume 34) air or gas is vented and not trapped in the enclosed volume.

Figure 13:
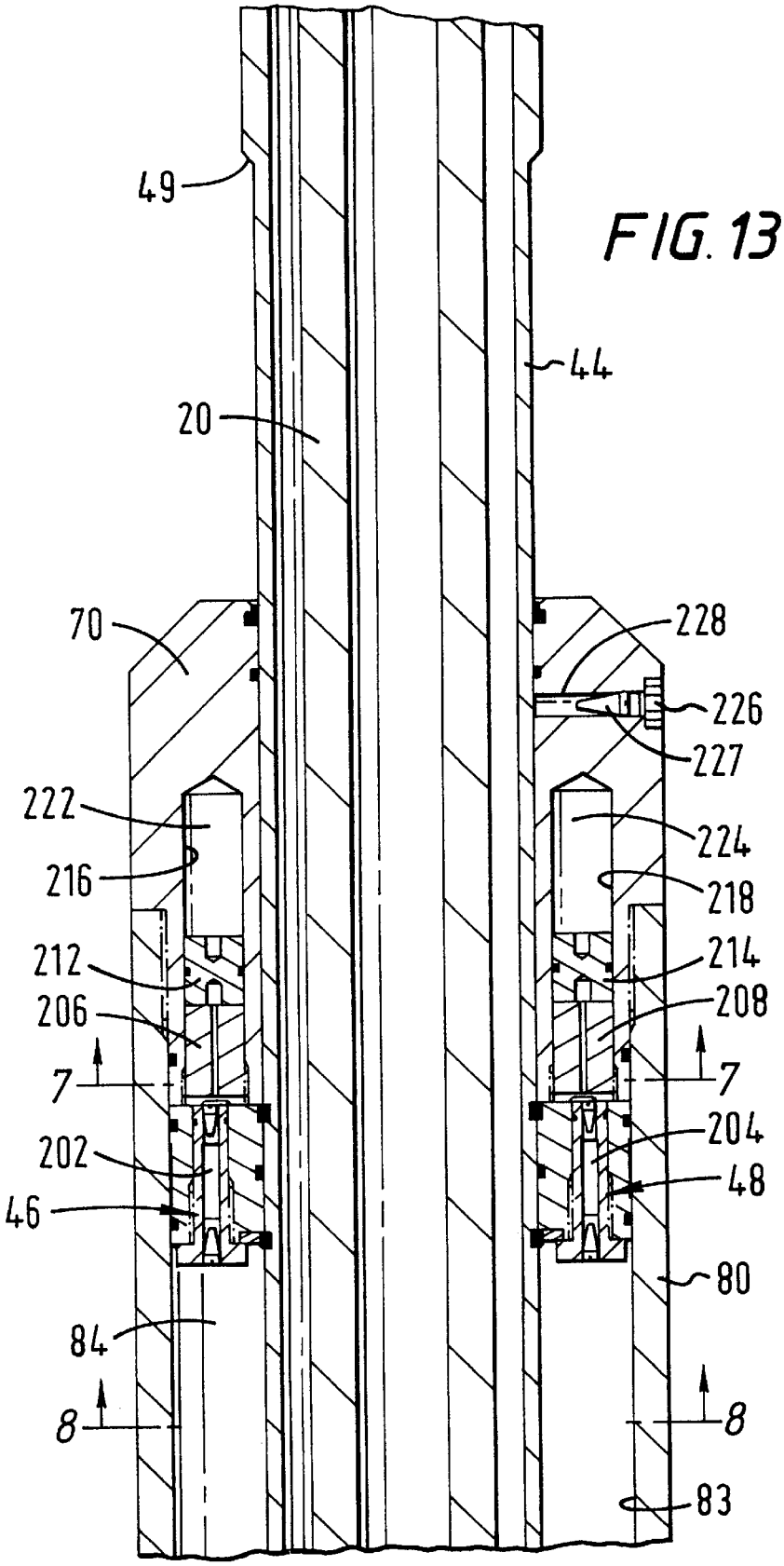
FIG. 13 shows an enlarged view of part of the system of FIG. 1.

As shown in detail in FIG. 13, the flow control assemblies 46, 48 are like the flow control assemblies 30, 32 described above and function in a similar fashion. However, in this embodiment, the flow control assemblies 46, 48 have no relief valves (flow is possible in either direction) and controlled-orifice fluid flow devices 202, 204 permit fluid flow at a significantly different rate than that of the assemblies 30, 32. In one aspect the controlled-orifice fluid flow device 202, 204 permit fluid to flow at a desired rate so that the sleeve 44 and connected items move down to the full extent of permitted movement in about 55 seconds.

Compression compensation devices 206, 208 are structured like and function as the piston 140 and piston retainer 130 (see FIG. 12 and descriptive text above). Pistons 212, 214 move in chambers 216, 218 respectively which contain amounts 222, 224 of compressible fluid. A removable plug 226 selectively closes off a fill channel 228 through which fluid may be introduced into the enclosed volume 84. A filtering screen 227 is disposed in the fill channel 228.

A shoulder 49 on the lower sleeve 44 permits the sleeve 44, the lower cap 60, and everything connected to or interconnected with the lower cap 60 to move down to the extent that the lower sleeve 44 moves within the body 90 and the cylinder cap 70. Space is provided between the exterior of the lower mandrel 22 and the inner surface of the body 90 in which the lower sleeve 44 may move downwardly.

The flow control assemblies 48, 48 are secured to the lower sleeve 44 (as the flow control assemblies 30, 32 are secured to the upper mandrel 20). Keyways in the sleeve 44 accommodate the pins 106.

Figure 14:
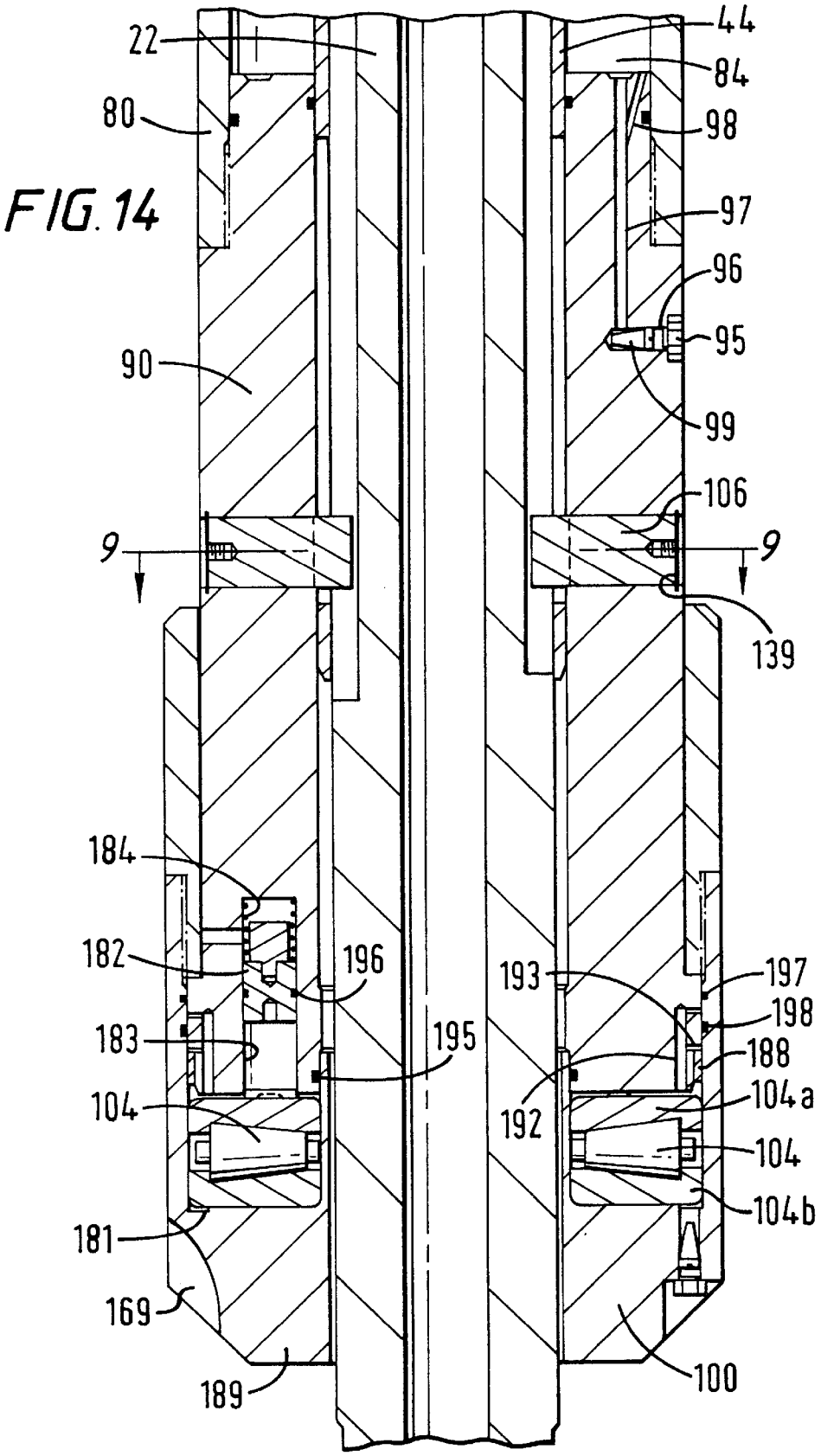
FIG. 14 shows an enlarged view of part of the system of FIG. 1.

As shown in FIG. 14, each pin 106 projects through the body 90, and into a keyway 28 of the lower mandrel 22, thus connecting the body 90 for rotation with the lower mandrel 22. A plug 95 is removably emplaced in a channel 96 which is in fluid communication with a channel 97 for filling (or evacuating) the enclosed volume 84. A filtering screen 99 is emplaced in the channel 96. A vent channel 98 prevents air entrapment.

The roller bearings 104 are disposed in a chamber 181 which is filled with bearing lubricant. A piston 182 movably disposed in a channel 183 is biased downwardly (to the right in FIG. 14) by a spring 184. The chamber 181 communicates with the channel 183 so that heated lubricant that expands (e.g. heated due to the rotation of the roller bearings 104) can move into the channel 183, pushing the piston 182 upwardly against the spring 184. An upper race 104*a* and a lower race 104*b* encompass the roller bearings 104. A side bearing 188 provides a side bearing for the end of the body 90 which is lubricated via channels 192 and 193. One or more pistons 182 may be used. An o-ring 195 seals the bearing housing/body interface. An o-ring 196 seals the piston/body interface. An o-ring 197 seals the body/bearing housing interface. An o-ring 198 seals an interface between a lower body 189 (in which the chamber 181 is located) and the body 90. Notches 169 permit fluid flow around the lower body 189 when it is seated on a wellhead. A retainer ring 139 holds the pins 106 in place.

FIG. 10 shows the position of the mandrel system following the descent and/or advance of the flow control assemblies 30, 32 in the enclosed volume 34.

Figure 11:
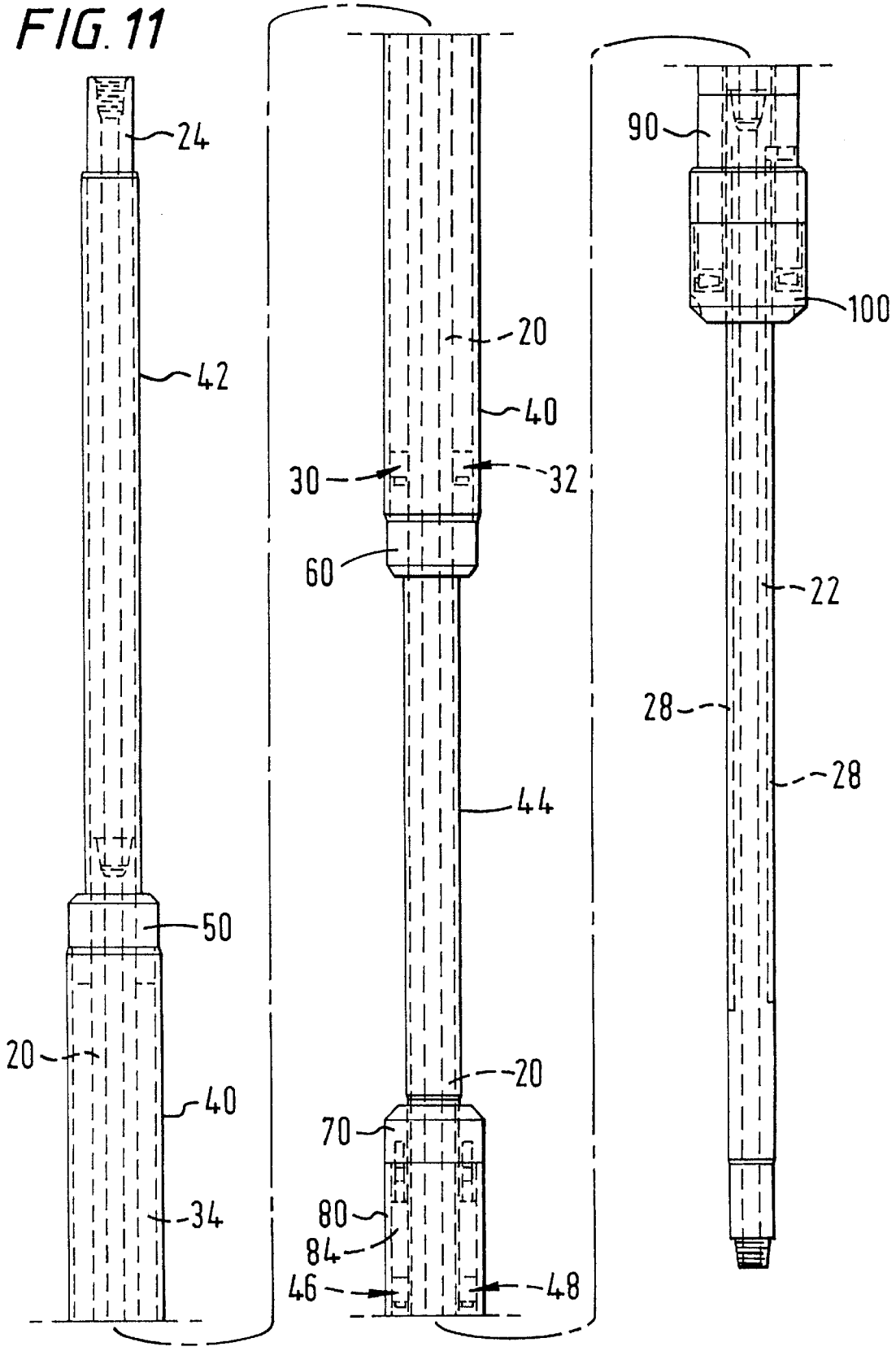
FIG. 11 is a side cross-section view of a system according to the present invention.

FIG. 11 shows the position of the mandrel system following the descent of the flow control assemblies 46, 48 in the enclosed volume 84.

Figure 15A:
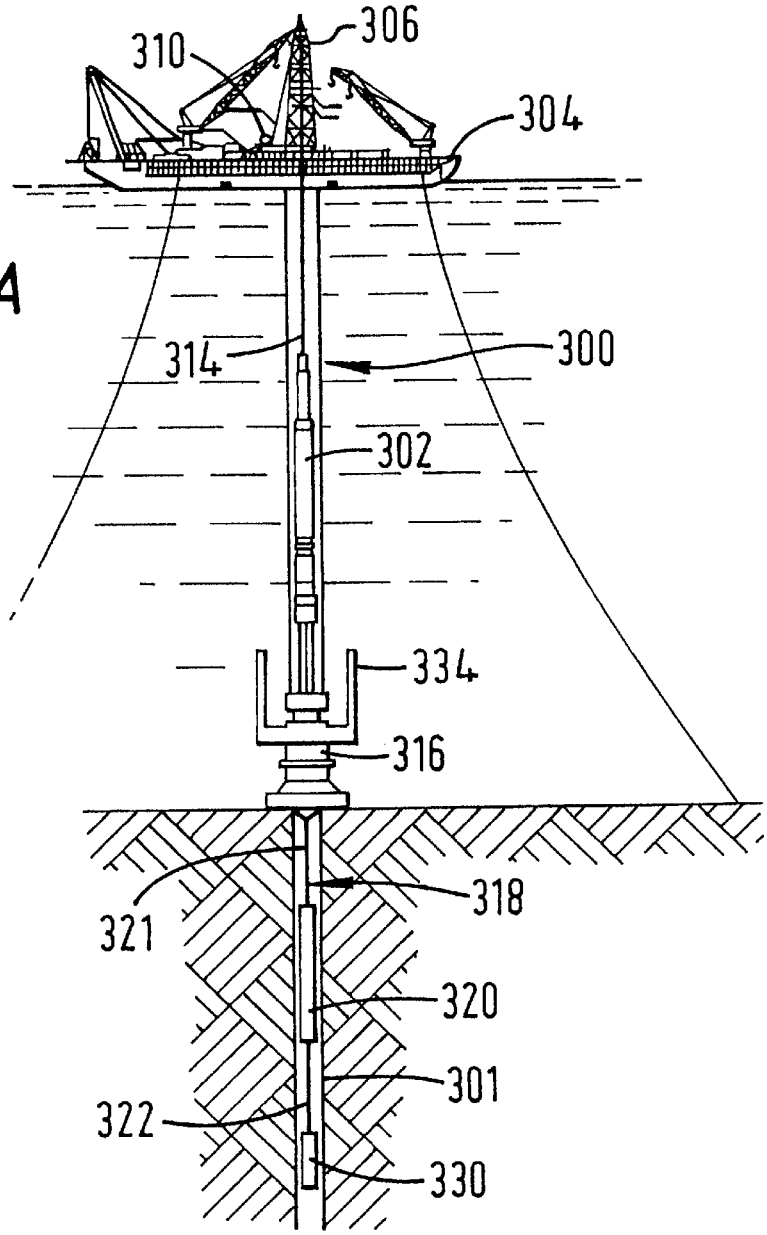
FIG. 15A is a schematic view of a system according to the present invention and FIG. 15B shows part of the system.
Figure 15B:
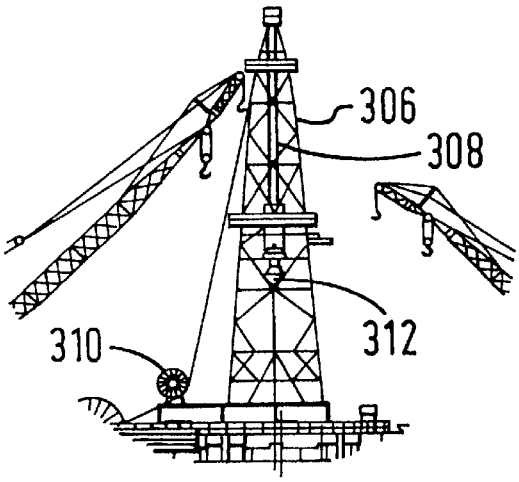

FIGS. 15A and 15B illustrate one particular embodiment of a milling system 300 employing a tool 302 (like the tool 10, FIGS. 1–14, described above). The tool 302 is part of a tubular string 314 extending down from a derrick 306 on a ship 304 into a wellbore 301. Support cables 308 support a swivel 312 which supports the string 314 and a typical drum and brake apparatus 310 controls raising and lowering of the cables and swivel. The string extends beneath the tool 302 as the string 318 which includes drill pipe 321, 322 and drill collars 320. A milling system 330 is connected to the drill pipe 322.

A bearing housing (like the bearing housing 100) has a lower end that rests on and against a corresponding cup or part (e.g. an upper end of a casing hanger) of a wellhead casing (in one aspect with a chamber to water a bevelled end of the housing) of the wellhead 316. Notches in the lower end (like the notches 169 of the bearing housing 100, FIG. 14) permit fluid flow between the bearing housing and the cup so that circulating fluid may flow up in the annulus between the tool and the casing that extends up to the sea floor and up to the ship 304.

In a typical operation of the system 300, the string 314, 318 with the milling system 330 is lowered into a main cased wellbore to contact a tubular to be milled, e.g. but not limited to, a liner of a lateral wellbore extending from the main wellbore; and milling produces a window or hole through the liner back into the main wellbore. The tool 302 is lowered so that it is seated in the cup 334 and the mill system 330 has contacted the liner (not shown). The flow control assemblies (corresponding to the flow control assemblies 30, 32, FIG. 1) permit a mill (or mills) of the mill system 330 to advance at a rate of about ¼ inch to ½ inch per minute, providing a controlled, relatively slow advance of the mill (s). This inhibits slipping of the mill on top of the liner—which can occur when the mill(s) advance too quickly—and also facilitates use of the mill system 330 with a milling guide as disclosed in pending U.S. application Ser. No. 08/590,747 filed on Jan. 24, 1996, which is incorporated fully herein for all purposes and is co-owned with the present invention.

Typically a ship 304 and known compensators and compensation systems make it possible for the ship to move up and down with waves and sea swells while the swivel and, therefore, the string stay at substantially the same level. However, extreme waves and sea swells cannot be handled by various known compensators and, when using a milling system like the system 300 with a tool 302 (or tools 10), a mill is pulled up off of the liner being milled and (in systems without a tool according to the present invention) the mill is pushed, slammed, or impacted back down into the liner. But, with the tool 302, upon raising of the mill in response to a wave or swell, the shoulder at the bottom of the bearing housing moves away from the cup of the wellhead 316. When this occurs, the flow control assemblies that control mill advance move up in their enclosed volume (e.g. the flow control assemblies 30, 32 in the enclosed volume 34; e.g. half-way up in this enclosed volume). Due to the check valves in the flow control assemblies, the flow control assemblies are prevented from moving back up to the top of the enclosed volume. As soon as the swell is past and weight is again on the milling system, the milling system (which has been continuously rotating) begins to progress downwardly again due to the subsequent downward progression of the flow control assemblies in the enclosed volume. Because of the distance of the lower flow control assemblies (e.g. the flow control assemblies 46, 48, FIG. 1) above the top end of the body (e.g. the body 90) the mill still does not instantly move back into contact with the liner. Not until the flow control assemblies move down to contact the body (see FIG. 11) does the mill move to re-contact the liner. For this reason in certain embodiments the lower flow control assemblies have flow orifices sized so that they move relatively quickly, e.g. in a minute, so that milling can quickly proceed following a swell.

In addition to providing timed controlled advance or movement of a wellbore tool or apparatus (or instead thereof), systems according to the present invention are used to advance or move a device or tool a known distance, either the entire distance of the stroke length of the system or an increment of that distance. In one aspect, the system is partially stroked at the surface, i.e., the flow control assemblies are allowed to move some known portion of the total stroke length of the tool so that whatever known portion remains may be stroked once the system is in the hole. In one aspect, the system is used with a mill and the mill's advance is stopped when the end of the system's stroke is reached.

Figure 16A:
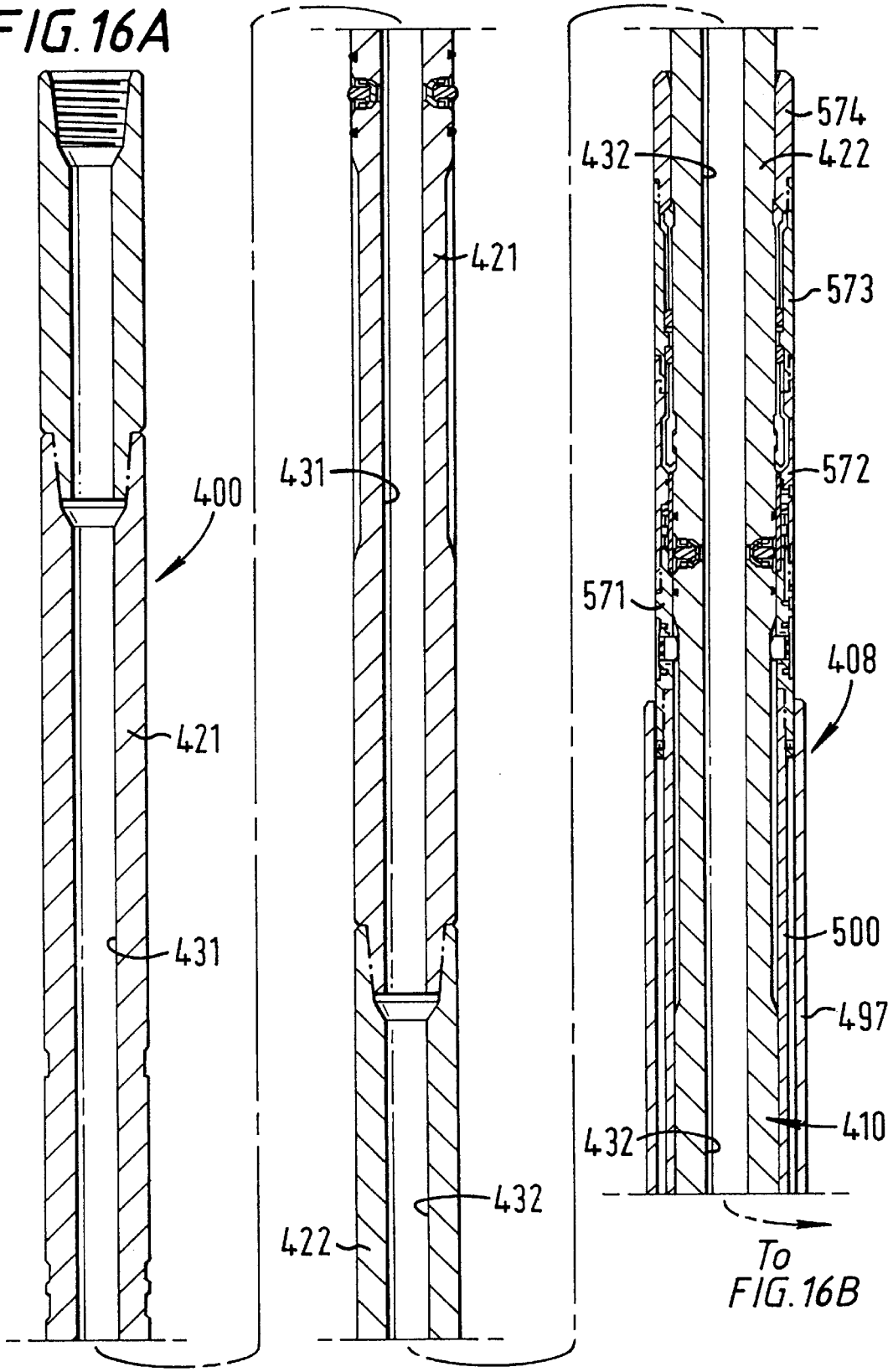
FIGS. 16A and 16B are side cross-section views which, taken together, show a system according to the present invention.
Figure 16B:
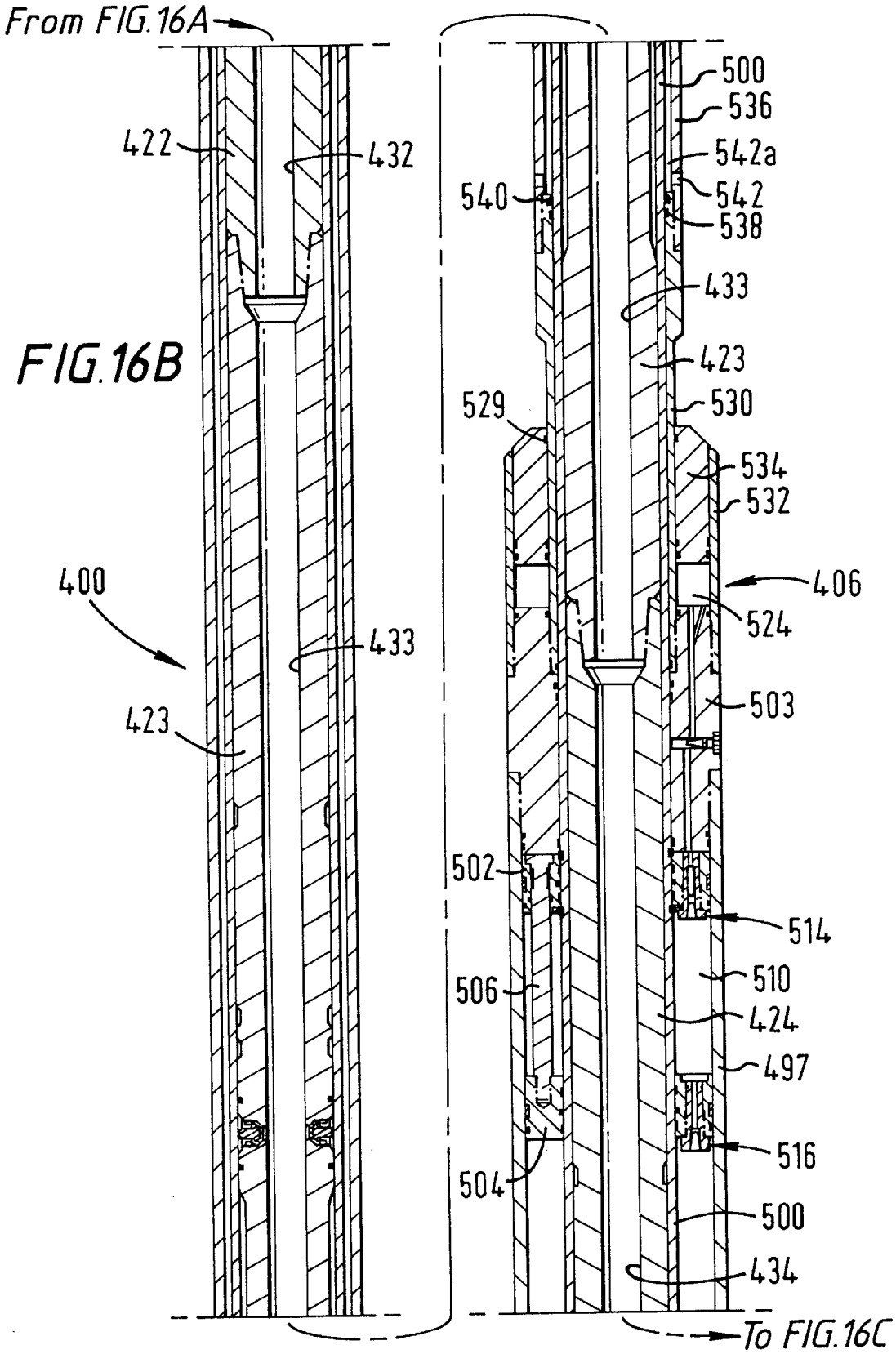
Figure 16C:
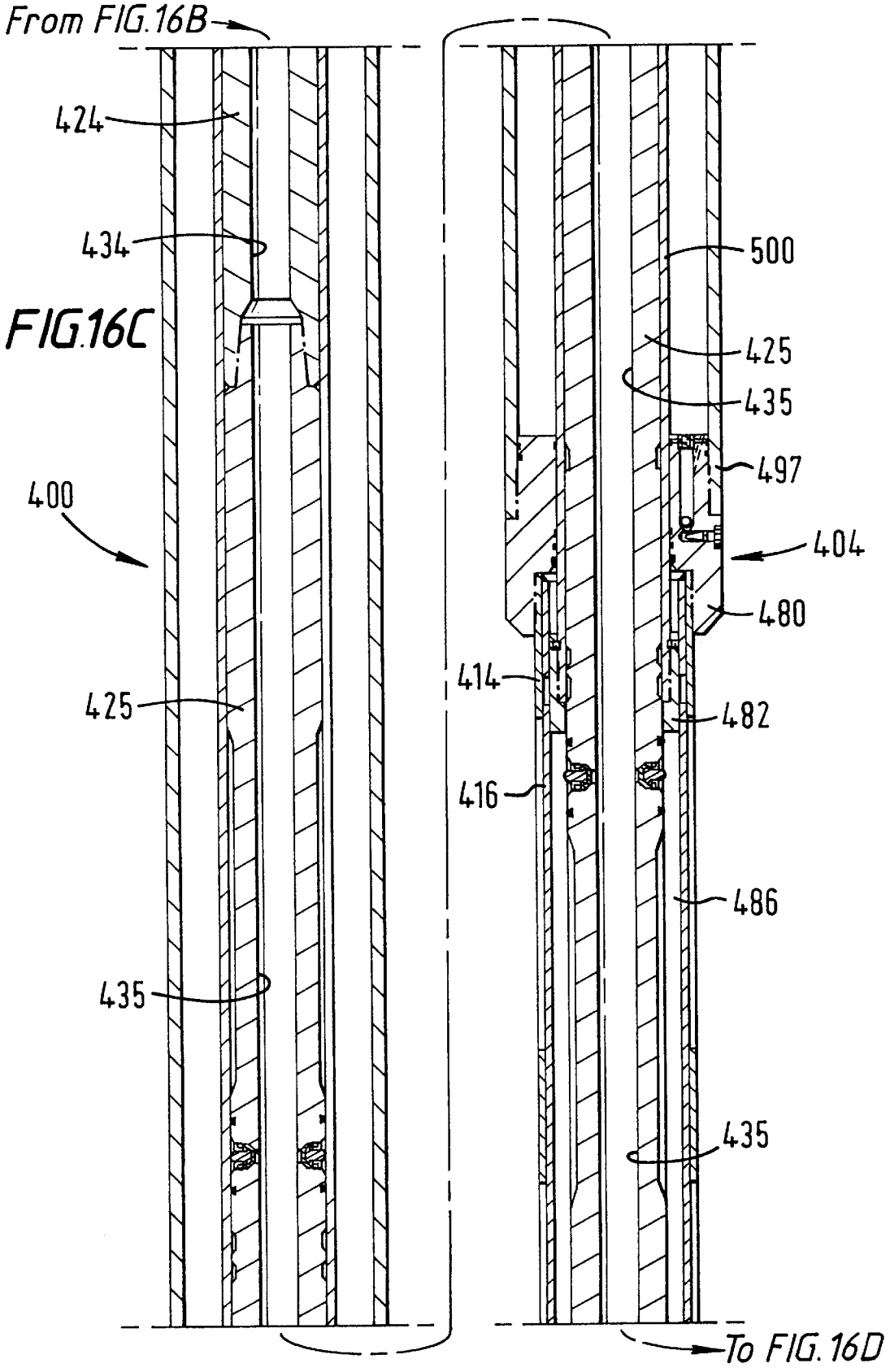
Figure 17A:
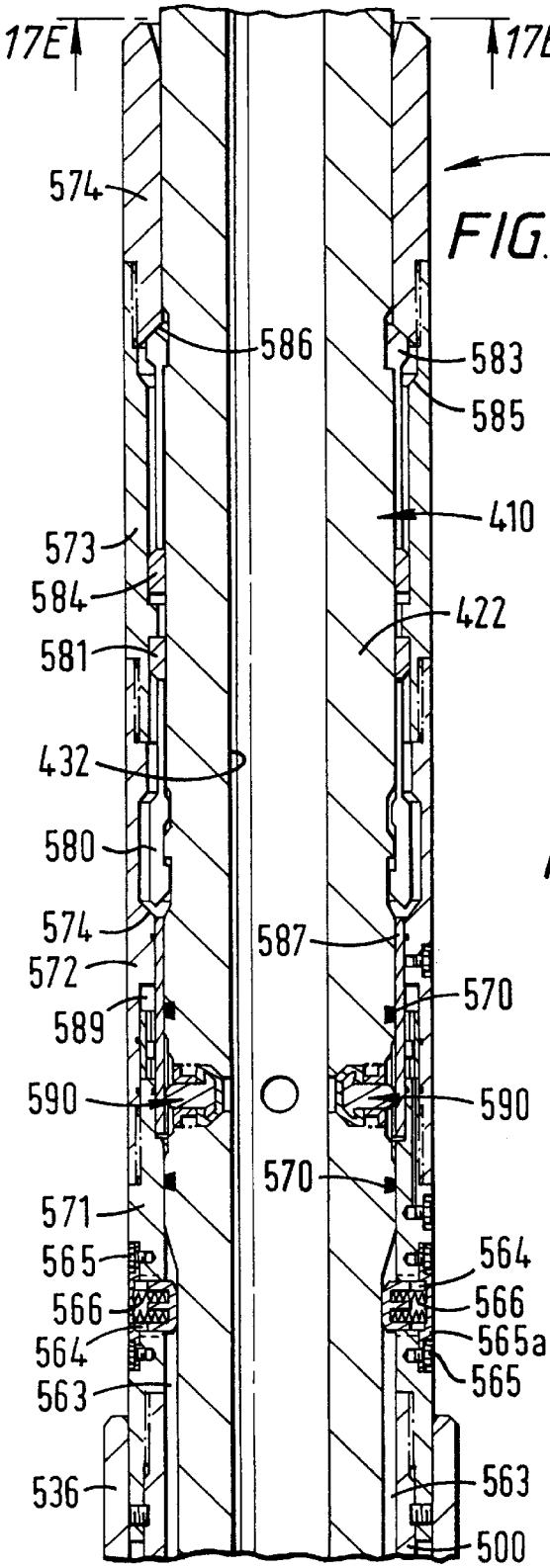
FIGS. 17A–17D, 18A–18B, 19A and 20 are enlargements of portions of the system of FIGS. 16A and 16B.
Figure 19A:
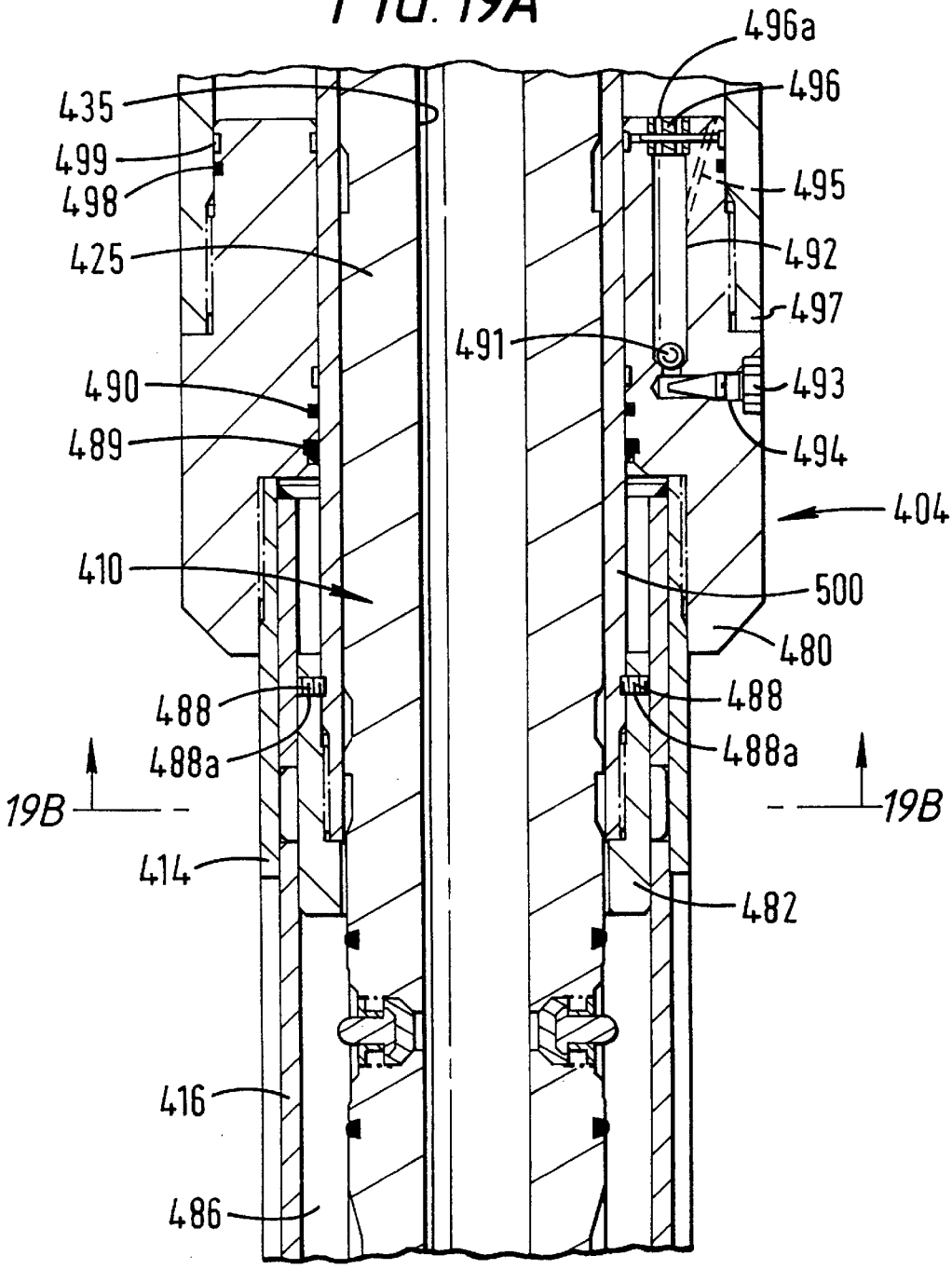
Figure 20:
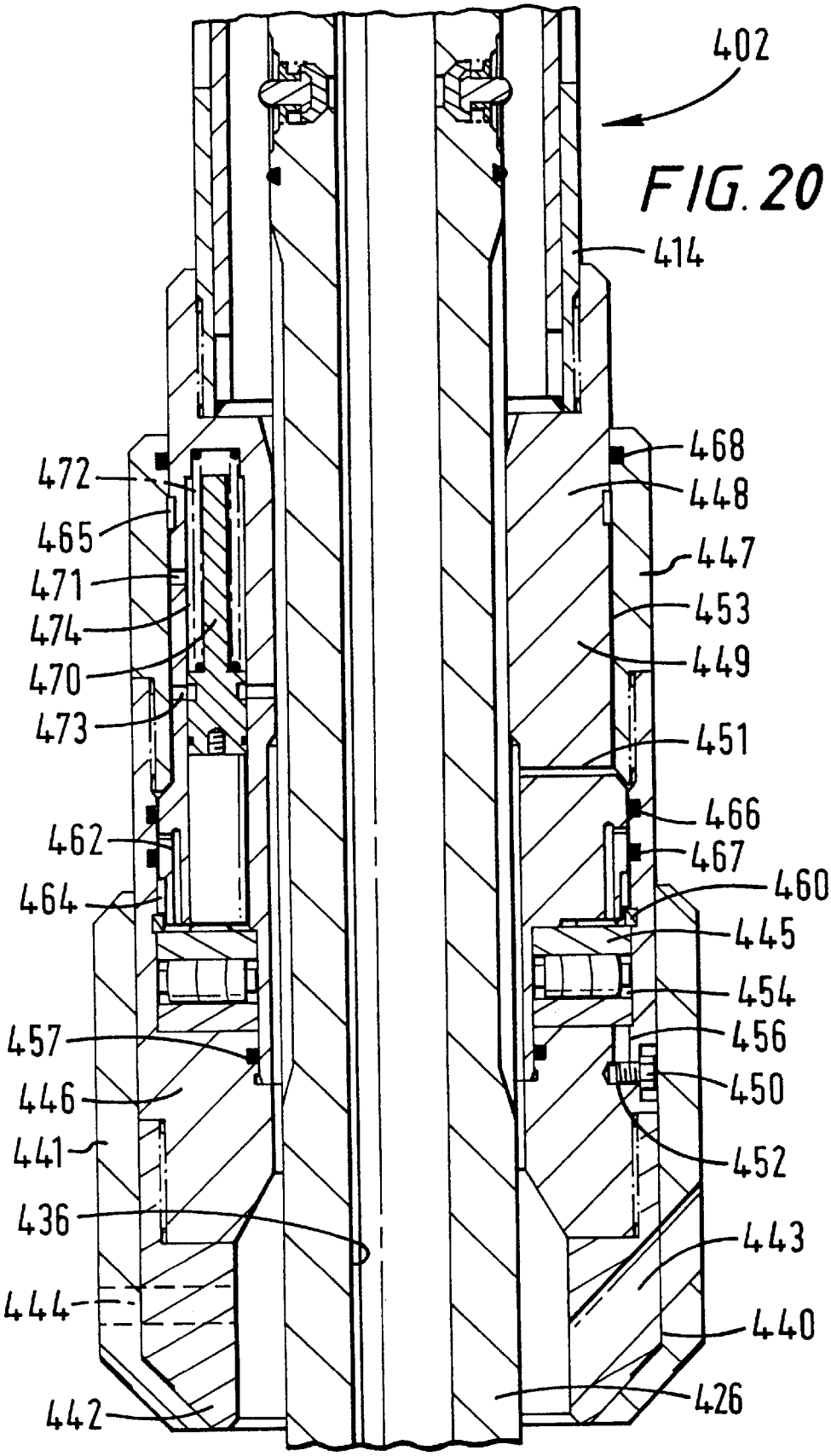

FIGS. 16A and 16B show a system 400 according to the present invention which has a lower portion 402 (see also FIG. 20); an intermediate portion 404 (see also FIG. 19A); a mid portion 406 (see also FIG. 18A); and a top portion 408 (see also FIG. 17A).

Figure 16D:
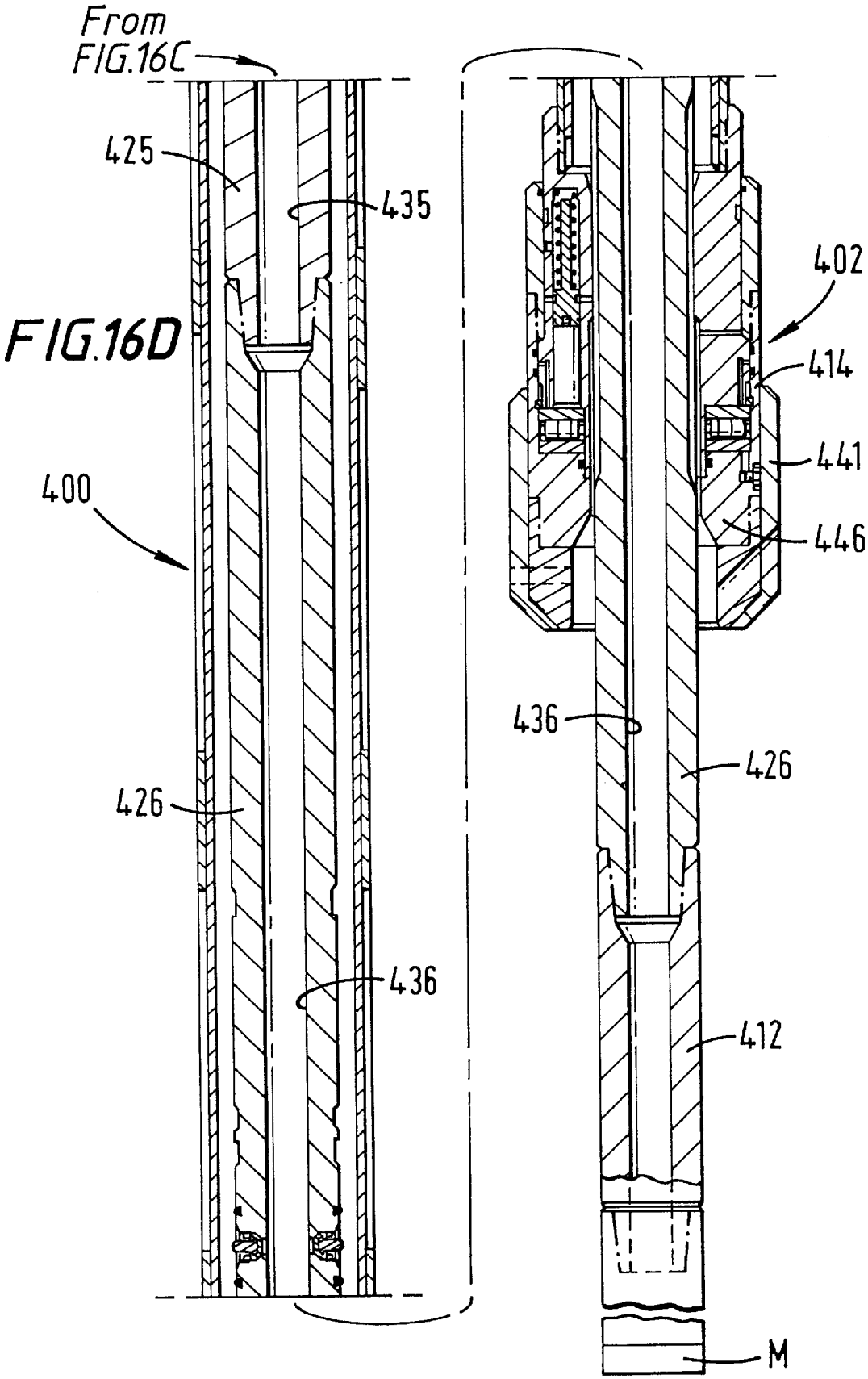

As shown in FIGS. 16A and 16B the system 400 is designed to land in a wellhead on an ocean floor; but it is within the scope of this invention to use such a system on a rig or fixed platform. A mandrel 410 that extends through the center of the system 400 is connected to a drill string 412 which itself is connected to a mill M shown schematically in FIG. 16D (any other suitable wellbore device or apparatus in addition to, or instead of the mill M may be interconnected with the drill string 412 and/or mandrel 410). It is within the scope of this invention to use the system 400 with any mill, milling system, drill, drilling system, mill-drill, or mill-drill system. The length of the drill string 412 may be any appropriate length, including, but not limited to, several hundred or thousand feet long.

The mandrel 410 includes six tubular sections 421, 422, 423, 424, 425, and 426 threadedly interconnected with the lowermost section 426 threadedly connected to the drill string 412 and each section with a flow bore 431, 432, 433, 434, 435 and 436, respectively, extending therethrough from top to bottom. However, any member of such sections may be used.

The lower portion 402 has a landing sub 440 shown with an outer portion 441 connected to an inner portion 442. As desired and depending on the size of the wellhead that the landing sub lands on, the outer portion 441 may be deleted or the inner portion 442 may be deleted. Alternatively a single lower portion of desired dimensions may be used. The landing sub nose is sized to correspond to the wellhead's size. So that fluid may circulate while the landing sub 440 is landed on a wellhead, flow bypass holes 443 (eight in this embodiment spaced apart around the sub) are provided through the landing sub 440. Holes 444 are assembly holes.

A cylindrical thrust roller bearing 445 is movably disposed in a compartment 454 in a bearing housing 446 that is threadedly connected to a connector 447. The connector 447 encircles a top part 448 of a lower body 449. Two plugs 450 are removably disposed in holes 452 (one shown) and may be removed to fill the bearing compartment 454 with lubricant, e.g. oil, via a port 456. A rotary seal 457 seals the bearing-housing-446/lower-body-449 interface. A metal snap ring 460 retains the bearing 445 in place.

A drill hole 462 intercommunicates between the bearing compartment 454 and two outer rotary seals 466 and 467 so that oil can lubricate these seals. Journal bearing 464 and 465 facilitate rotation of the lower body 449 with respect to the bearing housing 446. A rotary seal 468 seals the lower body 449's interface with the connector 447.

A hole 471 provides pressure equalization between pressure in the wellbore and pressure behind a piston 470. The piston 470 is urged downwardly by a spring 472 within a chamber 474 in fluid communication with the compartment 454 to overpressure (pressure greater than that of fluid in the wellbore) the oil in the compartment 454 to a pressure slightly higher than the pressure of the well fluid exterior to the system so that oil "weeps" past the seals 466, 467 to maintain lubrication of the seals. Drill holes 473 facilitate assembly. The lower body 449 is threadedly connected to a lower end of an outertube 414. The section 426 extends through the various parts of the lower portion 402. The pressure of the wellbore fluid is applied to the hole 471 via channels 451 and 453. An O-ring seals the piston 470/connector 447 interface.

The intermediate portion 404 (see FIG. 19A) has a hollow lower cylinder cap 480 through which extends the section 425 of the mandrel 410. The outer tube 414 welded to an inner tube 416 is threadedly connected to the cap 480. Instead of two welded tubes a single tube may be used. A sub 482 with lugs 484 is threadedly connected to a sleeve 500 and sets screw 488 in a hole 488*a* secures the sub 482 at its top to the sleeve 500. A void space 486 is between the interior of the tube 416 and the exterior of the section 425. The section 425 extends through the sleeve 500 and through the sub 482.

The lugs 484 move in slots 487 of the inner tube 416. A wiper scraper 489 scrapes mud from the sleeve 500 and inhibits its passage upward. A seal 490 (e.g. O-ring or Polypak seal, as may be any seal herein) seals the interface between the cap 480 and the sleeve 500.

A ball 491 is movably disposed in a channel 492 in the cap 480. A plug 493 is in a hole 494 in fluid communication with the channel 492. A fill hole 495 permits removal of air from the space above the cap 480. A plug 496 has holes 496*a* therethrough for fluid passage. The cap 480 is threadedly connected to an outer sleeve 497 and an O-ring 498 seals the 480/outer sleeve 497 interface. A bearing 499 aids translation of the cap 480 with respect to the outer sleeve.

Figure 18A:
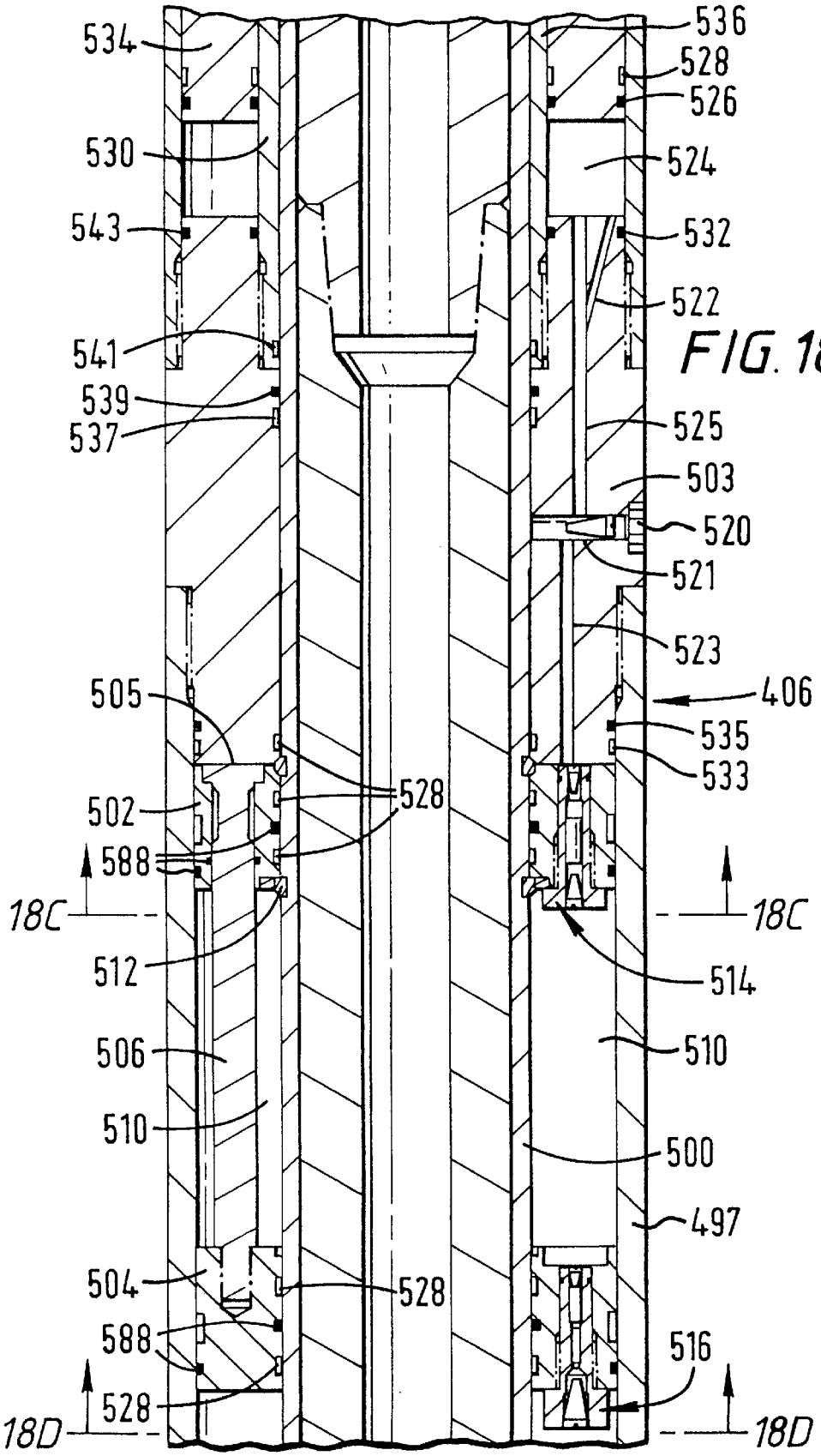

As shown in FIG. 18A, the mid portion 406 has a chamber 510 filled with fluid (e.g. but not limited to oil, or hydraulic fluid) between the inner sleeve 500 and the outer sleeve 497 in which is movably disposed a lower floating piston 504 which has one or more flow control devices 516 (three in the embodiment of FIG. 18A) therein which permit hydraulic fluid in the chamber 510 to flow therethrough from bottom to top of the piston 504 at a controlled rate. A check valve 505 prevents fluid flow in the opposite direction. The valve 505 may be a relief valve, and each flow controller 516 may include a relief valve—all such valves preventing top-to-bottom flow.

The lower ends of four rods 506 are connected to the piston 504 and an upper piston 502 is disposed on the upper ends of these rods 506 so that the piston is movable downwardly on the rods 506 with the rods guiding its movement until it abuts the lower piston. The piston 502 is secured to the inner sleeve 500 by metal snap rings 512 so that the inner sleeve 500 and piston 502 are movable downwardly together until the piston 502 abuts the piston 504—at which point the inner sleeve 500, piston 502, piston 504 and any apparatus (e.g. but not limited to a mill or milling system) connected to the drill string 412 move down together with their rate of movement controlled by the rate of fluid flow through the flow control devices 516 of the lower piston 504. Prior to such movement, i.e. prior to abutment of the upper piston 502 against the lower piston 504, the downward movement is controlled by the rate of flow of fluid through flow control devices 514 of the upper piston 502. These flow control devices 514 and 516 may be any suitable number and type, including flow control assembly, orifice, opening, valve, or control device, including but not limited to those of the Lee Co. described above. O-rings 589 seal various interfaces and journal beams 528 facilitate translation and/or rotation of adjacent members.

Figure 18B:
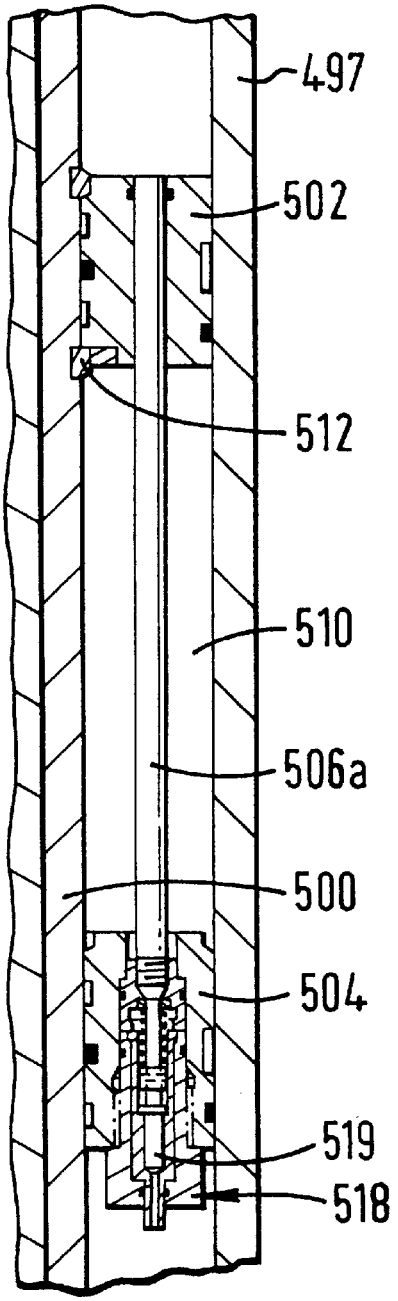
Figure 18C:
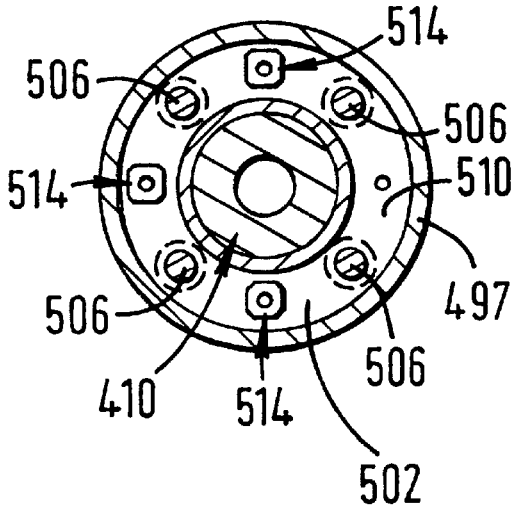
FIG. 18C and 18D are cross-section views of pistons of the system of FIG. 18A.
Figure 18D:
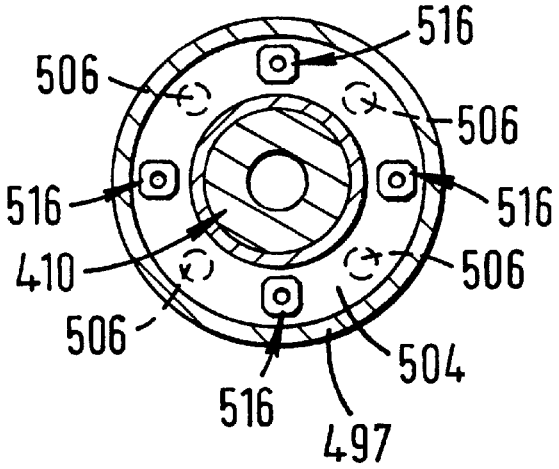

In one aspect the flow controller(s) of the upper piston 502 are designed, sized, and configured so that the upper piston (and items interconnected therewith) move about a foot in one minute. Also, there is, in this aspect, check valve in the upper piston 502 so it (and items interconnected therewith) can move back and forth in the chamber 510; i.e., if a milling system, e.g., on the drill string 412 is picked up or bounces off a tubular upwardly it will relatively quickly be moved back down with controlled movement to commence milling again. In this aspect the flow controller(s) of the lower piston 504 are designed, sized, and configured to allow the piston 504 (and items interconnected therewith via abutment of the piston 502 thereagainst) to move downwardly at a slower controlled rate, e.g. at about ¼ inch to ½ inch per minute or about ten feet in about eight hours, four hours, (total of 11' stroke) or in about forty-five minutes. As shown in FIG. 18B, (as described below) a reset valve 518 permits re-setting of the system downhole.

The outer sleeve 497 is threadedly connected to a body 503 against whose lower surface the upper piston 502 is initially positioned. A plug 520 is removably positioned in a channel 521 which is in fluid communication with channels 523 and 525 through the body 503. Hydraulic fluid may be pumped through the channels 521 and 523 and through pistons 502, 504 to fill the chamber 510. Hydraulic fluid may also be pumped through the channels 521 and 525 to a pressure equalization chamber 524. An expansion piston 534 (see FIGS. 16A and 18A) is movably disposed between a tube 536 and an expansion housing 532. The body 503 is threadedly connected to the expansion housing 532 and to the tube 536. An O-ring 526 seals the piston 534/housing 532 interface and a bearing 528 (made e.g. of Nylatron or Nylon) facilitates translation of the piston 534 with respect to the housing 532 and the tube 536.

Bearings 533, 537 and 541 facilitate translation and/or rotation of adjacent members. O-rings 535, 539, and 543 seal interfaces between adjacent members.

A fill port 522 facilitates removal of air from the chamber 524, e.g. during filling of the chamber 524.

The equalization chamber 524 and the piston 534 act to maintain the pressure in the chamber 510 substantially equal to that of fluid exterior to the system 400. E.g. while the system 400 is being run to depth, fluid within the chamber 510 can be compressed (e.g. due to hydrostatic pressure in the wellbore). Fluid exterior to the system 400 acts on the top of the piston 534 to compress the fluid within the system so it is at a pressure similar to that of the fluid exterior to the system. During operation, e.g. a milling operation, fluid within the system may heat up and expand. This causes the piston 534 to be moved upwardly in response to the increase in the pressure of the fluid within the system, thereby again equalizing interior and exterior fluid pressures.

The tube 530 is threadedly connected to an outer tube 536. A vent hole 542 is for fluid pressure equalization between the system (space 542*a* between mandrel 410 and the tube 536) and the wellbore. A bearing 538 in the tube 530 facilitates translation of adjacent members. A wiper ring rod scraper 540 inhibits fluid (e.g. mud) passage.

Figure 17B:
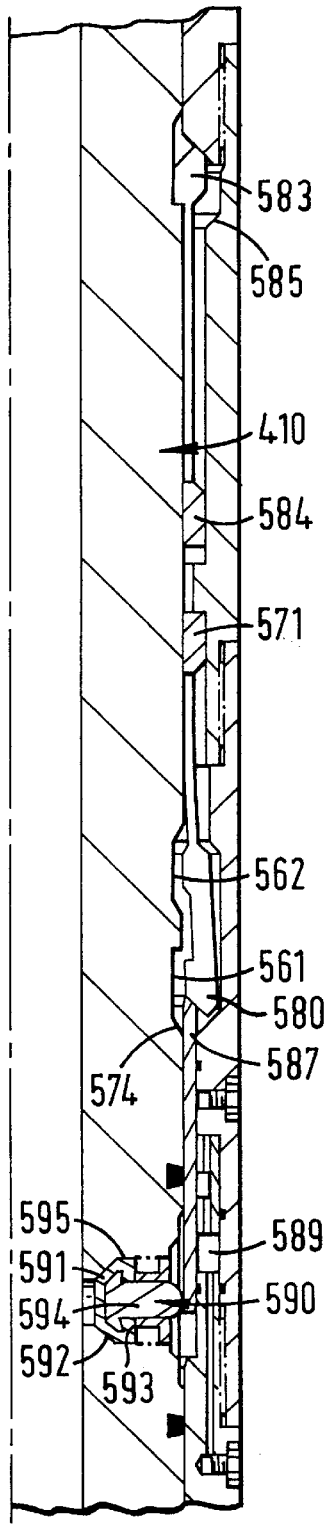

As shown in FIG. 17A, the upper portion 408 has a selective locking mechanism for releasably holding one of the sections of the mandrel 410. Each mandrel section has two selectively actuable poppet valves 590, locking grooves 561 and 562, and slots 563 (FIG. 17E) in which two bevelled lugs 564 are selectively positioned. Each mandrel section has the slots 563 in which the lugs 564 selectively reside. When the lugs 564 are in the mandrel slots torque is transmitted from the mandrel 410 (which is connected to a rotatable tubular string extending up to a surface rotating apparatus) to the system 400, loading the upper piston to begin the system's stroke. Four hollow bodies 571, 572, 573, and 574 house components of the locking mechanism. A lower end of the lowest body 571 is threadedly connected to a top end of the sleeve 500 and held between the sleeve 500 and the tube 536. Screws 565 hold a plate 565*a* over lugs 564 in the body 571. Springs 566 urge the lugs 564 inwardly.

Seals 570 seal various interface between adjacent members and one seal 570 seals the interface between the body 571 and the mandrel 410. The body 572 has a recess 574 therearound for selectively and releasably holding a free floating collet 580 with a top 581. A body 573 is threadedly connected to the body 572 (at the bottom) and to the body 574 (at the top).

An upper free floating collet 583 has an end 584 within the body 573. The upper collet is selectively movable into a recess 585 around the body 573 or recess 586 of the mandrel section 422.

In operation the lower collet 580 bears the "set down" weight (weight of the system) e.g. during a milling operation. When the system is lifted, e.g. for reaming (to real a wellbore) a load (system weight) is imposed on the upper collet 583.

Each mandrel section has two (and may have one or more) poppet valves 590 which control flow from within the system to the exterior thereof, and vice versa. The valves 590 have a valve body 591 with a valve seat 592, a valve seat 593 and a valve member 594 movably disposed in a channel 595 through the body 591. Initially a piston 587 holds each valve open by abutting an outer end of the valve member 594. The piston 587 is movably disposed in a chamber 588 and, as shown in FIG. 17A, is not initially in contact with the lower collet 580, i.e., the lower collet 580 is releasably holding the mandrel section 422.

Figure 17C:
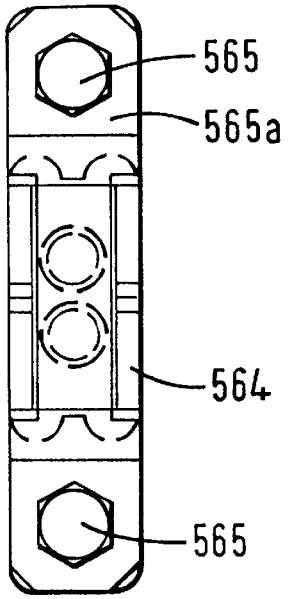
Figure 17D:
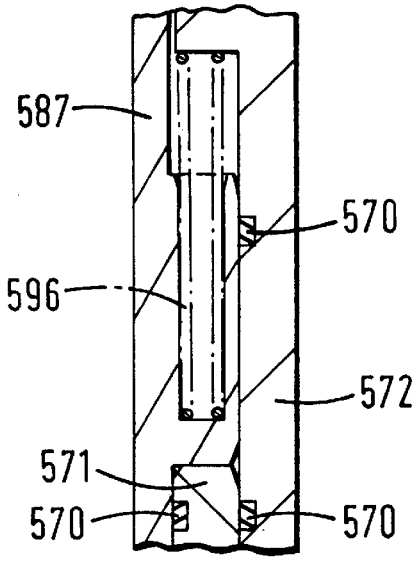
Figure 17E:
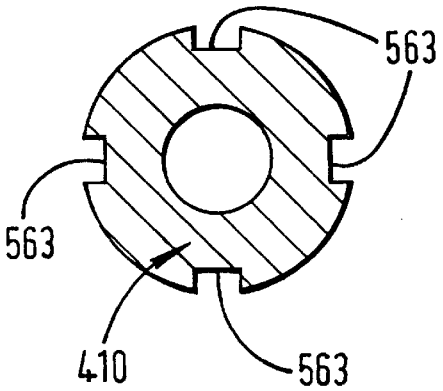
FIG. 17E is a cross-section view of a mandrel of the system of FIG. 17A.
Figure 19B:
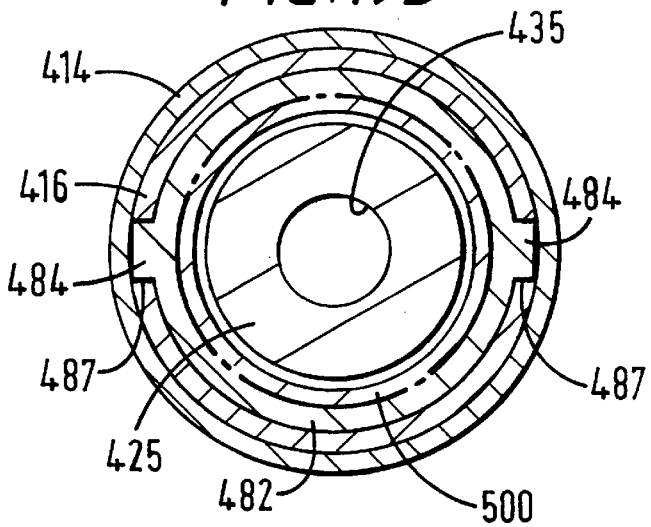
FIG. 19B is a cross-section view along line 19B—19B of FIG. 19A.

Once the pistons 502 and 504 have moved to permit a stroke of the system 400 (in one aspect, as discussed above, about a total of eleven feet with ten feet for milling) another tubular must be added to a string to which the mandrel 410 is connected to permit another stroke of the system; e.g. in one aspect another ten feet of milling. For this to occur, the collet 580 must be released from the section 422. To accomplish this, a downhole valve is activated that closes of the central flow channel through the drill string and, therefore, through the system 400. The valve is open for milling and may be any suitable commercially available valve, in one aspect a valve activated by a plug as a valve member which, in one aspect, is lowered on a wellbore. At sufficient pressure (e.g. in one aspect about 2500 pounds force), fluid flows through the bodies 591 of the valves 590 and enters the chamber 588. Due to the differential pressure acting on the piston 587, it moves up forcing the lower collet 580 away from the mandrel 422 (see FIG. 17B), freeing the mandrel 410 for movement. Thus the mandrel 410 may be lowered (in one aspect following addition of another tubular at the surface) for another stroke of the system 400. A relief valve in the piston 587 selectively allows top-to-bottom flow and controls the pressure at which the piston 587 moves so that the piston 587 moves up only at a known pre-selected pressure, e.g. 2500 pounds or greater. FIG. 17C shows the plate 565*a* over the lugs 564. FIG. 17D shows part of the piston 587 and a return spring 596 for the piston 587.

The system 400 may be used, in one aspect, instead of the tool 302, FIG. 15A. In one method, the system 400 is used in the situation of ocean swells as previously described for the system 300. In one method of use, the system 400 is lowered so that it lands in a wellhead (e.g. wellhead 316, FIG. 15A) and set down weight is then applied to the system. The load of this weight is transmitted to the sleeve 500 and thus to the upper piston 502 and movement of the upper piston 502 in the chamber 510 commences. If, e.g. a mill system (like the system 330, FIG. 15A) is being used, the mill system is being moved into contact with an item (e.g. but not limited to a fish or a packer) or a tubular to be milled. The first foot of movement goes relatively fast when the piston 502 is the embodiment with flow controllers that permit a foot of movement per minute.

Rotation of the tubular string (e.g. the string 314, FIG. 15A) to which the mill system is connected rotates the mill system for milling. The upper piston 502 moves to abut the lower piston 504 and continued movement of the system 400 and the attached mill system is governed by the rate of fluid flow through the flow controller(s) of the lower piston 504 (e.g., in certain aspects, about one fourth inch a minute). Milling is conducted for the length of the system 400's stroke, e.g. a total of about ten feet in certain embodiments.

If it is desired to mill further, following resetting of the system 400 an additional tubular may be necessary and is then added at the surface so that further milling is possible. Re-set of the system 400 is accomplished by the re-set valve 518 which has a two-way toggling valve member 519. When the lower piston 504 reaches the lower limit of its travel, the valve member 519 contacts the top of the cap 480 (and/or of the plug 496), shifting the valve member 519 so that fluid can flow from top to bottom of the piston 504; thus the pistons are permitted to move back up to the top of the chamber 510 as the mandrel 410 is raised at which point the top end of the rod 506*a* contacts a lower surface of the body 503 shifting the valve member so that top-to-bottom flow through the piston is no longer possible.

At the surface another tubular is added to the string to which the mandrel 410 is connected (e.g. a thirty foot drill pipe). Now further milling is possible corresponding to the length of the added tubular.

To free the tubular string, the lower collet 580 is released from the mandrel section it is holding by closing a valve or other suitable plugging mechanism below the system 400 so that fluid under pressure may be applied to shift the piston 587, thereby releasing the collet 580 from the mandrel section. Again the system 400 is lowered (following re-set of the system and associated raising thereof) until it lands on the wellhead. Lowering effects release of the lugs 564 from their mandrel section slots and the mandrel 410 with the system 400 is lowered. Fluid pressure is maintained within the system 400 during lowering so the collet 580 remains expanded.

Upon sufficient lowering, the lugs 564 are again adjacent slots in the next mandrel section. Thus while lowering ensues, the lugs 564 move into the new section's slots. Pressure is then bled from the center of the mandrel 410 allowing the collet 580 to pop into the locking grooves of the new mandrel section. With fluid pressure released, the system 400 is ready to execute another stroke and further milling is commenced.

The present invention, in certain embodiments, discloses a wellbore motion control apparatus for controlling the motion of a tubular wellbore string in a wellbore extending from a surface down into the earth, the motion control apparatus having a central mandrel connected to the tubular wellbore string, a housing with a top end, a bottom end, and a hollow interior having an interior volume with fluid therein, at least one fluid passage apparatus having a top end and a bottom end and disposable in the hollow interior of the housing, the at least one fluid passage apparatus having a fluid flow channel extending therethrough from the top end to the bottom end, and the at least one fluid passage apparatus secured to the central mandrel, the housing surrounding the central mandrel, the at least one fluid passage apparatus disposed for movement in a chamber defined by an inner surface of the housing and an outer surface of the central mandrel, the at least one fluid passage apparatus positioned within the chamber so that fluid therein is flowable through the fluid flow channel from one end of the fluid passage apparatus to the other end of the fluid passage apparatus permitting movement of the fluid passage apparatus within the chamber and thereby controlling movement of the mandrel and therefore of the tubular wellbore string in the wellbore; such a wellbore motion control apparatus wherein the mandrel has top end and a bottom end, the bottom end connectible to another apparatus; any such wellbore motion control apparatus wherein the mandrel has a fluid flow bore therethrough from the top end thereof to the bottom end thereof; any such wellbore motion control apparatus wherein the at least one fluid passage apparatus is at least two fluid passage apparatuses; any such wellbore motion control apparatus wherein the fluid in the housing is liquid (e.g. but not limited to oil or hydraulic fluid); any such wellbore motion control apparatus wherein the fluid flow channel is sized so that the fluid passage apparatus traverses the chamber from one end thereof to the other end thereof in about an hour or in about a minute; any such wellbore motion control apparatus having at least one piston movably disposed in the chamber, and the at least one fluid passage apparatus secured to the at least one piston; any such wellbore motion control apparatus wherein the at least one piston includes a first upper piston and a second lower piston, each movably disposed in the chamber, the first upper piston secured to the central mandrel so the central mandrel moves with the first upper piston, and the at least one fluid passage apparatus including at least one first fluid passage apparatus for the first upper piston and at least one second fluid passage apparatus for the second lower piston, the first upper piston movable about at least one rod connected to the second lower piston so that the first upper piston is movable downwardly on the at least one rod as fluid passes through the at least one first fluid passage to move to abut the second lower piston; any such wellbore motion control apparatus wherein fluid in the chamber is flowable through the at least one first fluid passage apparatus at a first flow rate and through the at least one second fluid passage apparatus at a second flow rate, the first flow rate greater than the second flow rate, so that the central mandrel moves at the first flow rate and then moves thereafter at the second flow rate; any such wellbore motion control apparatus wherein the first flow rate is such that the first upper piston is movable in response to weight of the wellbore motion control apparatus therebelow at about a foot per minute and the second upper piston is movable following abutment therewith of the first upper piston at a rate between about ¼ inch and about ½ inch per minute; any such wellbore motion control apparatus wherein the tubular wellbore string has a lower end and the wellbore motion control apparatus including cutting apparatus attached at the lower end of the tubular wellbore string; any such wellbore motion control apparatus wherein the cutting apparatus is from the group consisting of tubular milling apparatus, drilling apparatus, and mill-drill apparatus; any such wellbore motion control apparatus with a check valve apparatus in the second lower piston for permitting flow therethrough from the bottom thereof to the top thereof and out therefrom into space thereabove, the check valve apparatus preventing fluid flow in the opposite direction from the space thereabove to a space below the second lower piston; any such wellbore motion control apparatus with re-set apparatus for re-setting the system in a wellbore, and/or with locking apparatus adjacent the central mandrel for releasably holding the central mandrel; any such wellbore motion control apparatus wherein the locking apparatus further comprising an outer body around the central mandrel, a collet between the outer body and the central mandrel, at least one collet receiving recess in the central mandrel, and collet movement apparatus for selectively moving the collet into locking engagement in the at least one collet receiving recess and for selectively moving the collet out from the at least one collet receiving recess; any such wellbore motion control apparatus wherein the collet movement apparatus includes a piston with a portion thereof movable into and out of contact with the collet to move the collet out of the at least one collet receiving recess, the collet movable back therein upon movement of the piston away from the collet, the piston mounted between the outer body and the central mandrel and movable in response to fluid pressure flowing through the central mandrel into a space between the outer body and the central mandrel in which the piston is disposed; and any such wellbore motion control apparatus with valve apparatus in a channel through the central mandrel for selectively controlling fluid flow from within the central mandrel into the space containing the piston.

In certain aspects the present invention discloses a method for controlling the motion of a tubular string used in wellbore operations, the method comprising connecting a wellbore motion control apparatus in the tubular string, the wellbore motion control apparatus as described above, and flowing the fluid in the chamber of the wellbore motion control apparatus from a space below the at least one fluid passage apparatus, through the at least one fluid passage apparatus, to a space above the at least one fluid passage apparatus as the at least one fluid passage apparatus moves down in the chamber thereby controllably moving the tubular string down; the method, in one aspect, including moving the central mandrel at a first flow rate and then moving the central mandrel at a second flow rate, and wherein, in certain aspects, the first flow rate is such that the first upper piston is movable in response to weight of the wellbore motion control apparatus therebelow at about a foot per minute and the second upper piston is movable following abutment therewith of the first upper piston at a rate between about ¼ inch and about ½ inch per minute; the method including, in certain aspects, re-setting the wellbore motion control apparatus in a wellbore with the re-set apparatus and/or selectively locking the central mandrel with the locking apparatus.

The present invention, in certain aspects, discloses a tubular member for wellbore operations which has a generally cylindrical body with a top end and a bottom end, a fluid flow bore extending through the generally cylindrical body from the top end to the bottom end, at least one channel through the body permitting fluid communication between the fluid flow bore and space exterior to the tubular member, at least one valve apparatus (in one aspect, two) in the at least one channel (in one aspect, two, each with valve apparatus therein) for selectively controlling fluid flow through the at least one channel, and at least one collet receiving recess in which a collett may be releasably positioned.

In conclusion, therefore, it is seen that the present invention and the embodiments disclosed herein and those covered by the appended claims are well adapted to carry out the objectives and obtain the ends set forth. Certain changes can be made in the subject matter without departing from the spirit and the scope of this invention. It is realized that changes are possible within the scope of this invention and it is further intended that each element or step recited in any of the following claims is to be understood as referring to all equivalent elements or steps. The following claims are intended to cover the invention as broadly as legally possible in whatever form it may be utilized. The invention claimed herein is new and novel in accordance with 35 U.S.C. § 102 and satisfies the conditions for patentability in § 102. The invention claimed herein is not obvious in accordance with 35 U.S.C. § 103 and satisfies the conditions for patentability in § 103. This specification and the claims that follow are in accordance with all of the requirements of 35 U.S.C. § 112.

What is claimed is:

1. A wellbore motion control apparatus for controlling the motion of a tubular wellbore string in a wellbore extending from a surface down into the earth, the motion control apparatus comprising a central mandrel connected to the tubular wellbore string, a housing with a top end, a bottom end, and a hollow interior having an interior volume with fluid therein, at least one fluid passage apparatus having a top end and a bottom end and disposable in the hollow interior of the housing, the at least one fluid passage apparatus having a fluid flow channel extending therethrough from the top end to the bottom end, and the at least one fluid passage apparatus secured to the central mandrel, the housing surrounding the central mandrel, the at least one fluid passage apparatus disposed for movement in a chamber defined by an inner surface of the housing and an outer surface of the central mandrel, the at least one fluid passage apparatus positioned within the chamber so that fluid therein is flowable through the fluid flow channel from one end of the fluid passage apparatus to the other end of the fluid passage apparatus permitting movement of the fluid passage apparatus within the chamber and thereby controlling movement of the mandrel and therefore of the tubular wellbore string in the wellbore.

2. The wellbore motion control apparatus of claim 1 wherein the mandrel has a top end and a bottom end, the bottom end connectible to another apparatus.

3. The wellbore motion control apparatus of claim 1 wherein the mandrel has a fluid flow bore therethrough from the top end thereof to the bottom end thereof.

4. The wellbore motion control apparatus of claim 1 wherein the at least one fluid passage apparatus is at least two fluid passage apparatuses.

5. The wellbore motion control apparatus of claim 1 wherein the fluid in the housing is liquid.

6. The wellbore motion control apparatus of claim 5 wherein the fluid in the housing is oil.

7. The wellbore motion control apparatus of claim 1 wherein the fluid flow channel is sized so that the fluid passage apparatus traverses the chamber from one end thereof to the other end thereof in about an hour.

8. The wellbore motion control apparatus of claim 1 wherein the fluid flow channel is sized so that the fluid passage apparatus traverses the chamber from one end thereof to the other end thereof in about a minute.

9. The wellbore motion control apparatus of claim 1 further comprising at least one piston movably disposed in the chamber, and the at least one fluid passage apparatus secured to the at least one piston.

10. The wellbore motion control apparatus of claim 9 wherein the at least one piston includes a first upper piston and a second lower piston, each movably disposed in the chamber, the first upper piston secured to the central mandrel so the central mandrel moves with the first upper piston, and the at least one fluid passage apparatus including at least one first fluid passage apparatus for the first upper piston and at least one second fluid passage apparatus for the second lower piston, the first upper piston movable about at least one rod connected to the second lower piston so that the first upper piston is movable downwardly on the at least one rod as fluid passes through the at least one first fluid passage to move to abut the second lower piston.

11. The wellbore motion control apparatus of claim 10 wherein fluid in the chamber is flowable through the at least one first fluid passage apparatus at a first flow rate and through the at least one second fluid passage apparatus at a second flow rate, the first flow rate greater than the second flow rate, so that the central mandrel moves at the first flow rate and then moves thereafter at the second flow rate.

12. The wellbore motion control apparatus of claim 11 wherein the first flow rate is such that the first upper piston is movable in response to weight of the wellbore motion control apparatus therebelow and the second upper piston is movable following abutment therewith of the first upper piston at a rate between ¼ inch and ½ inch per minute.

13. The wellbore motion control apparatus of claim 10 further comprising a check valve apparatus in the second lower piston for permitting flow therethrough from the bottom thereof to the top thereof and out therefrom into space thereabove, the check valve apparatus preventing fluid flow in the opposite direction from the space thereabove to a space below the second lower piston.

14. The wellbore motion control apparatus of claim 1 wherein the tubular wellbore string has a lower end and the wellbore motion control apparatus including cutting apparatus attached at the lower end of the tubular wellbore string.

15. The wellbore motion control apparatus of claim 14 wherein the cutting apparatus is from the group consisting of tubular milling apparatus, drilling apparatus, and mill-drill apparatus.

16. The wellbore motion control apparatus of claim 1 further comprising a re-set apparatus for re-setting the wellbore motion control apparatus in a wellbore.

17. The wellbore motion control apparatus of claim 1 further comprising a locking apparatus adjacent the central mandrel for releasably holding the central mandrel.

18. The wellbore motion control apparatus of claim 17 further comprising the locking apparatus further comprising an outer body around the central mandrel, a collet between the outer body and the central mandrel, at least one collet receiving recess in the central mandrel, and a collet movement apparatus for selectively moving the collet into locking engagement in the at least one collet receiving recess and for selectively moving the collet out from the at least one collet receiving recess.

19. The wellbore motion control apparatus of claim 18 wherein the collet movement apparatus includes a piston with a portion thereof movable into and out of contact with the collet to move the collet out of the at least one collet receiving recess, the collet movable back therein upon movement of the piston away from the collet, the piston mounted between the outer body and the central mandrel and movable in response to fluid pressure flowing through the central mandrel into a space between the outer body and the central mandrel in which the piston is disposed.

20. The wellbore motion control apparatus of claim 19 further comprising a valve apparatus in a channel through the central mandrel for selectively controlling fluid flow from within the central mandrel into the space containing the piston.

21. A method for controlling the motion of a tubular string used in wellbore operations, the method comprising connecting a wellbore motion control apparatus in the tubular string, the wellbore motion control apparatus comprising a central mandrel connected to the tubular wellbore string, a housing with a top end, a bottom end, and a hollow interior having an interior volume with fluid therein, at least one fluid passage apparatus having a top end and a bottom end and disposable in the hollow interior of the housing, the at least one fluid passage apparatus having a fluid flow channel extending therethrough from the top end to the bottom end, and the at least one fluid passage apparatus secured to the central mandrel, the housing surrounding the central mandrel, the at least one fluid passage apparatus disposed for movement in a chamber defined by an inner surface of the housing and an outer surface of the central mandrel, the at least one fluid passage apparatus positioned within the chamber so that fluid therein is flowable through the fluid flow channel from one end of the fluid passage apparatus to the other end of the fluid passage apparatus permitting movement of the fluid passage apparatus within the chamber and thereby controlling movement of the mandrel and therefore of the tubular wellbore string in the wellbore, and flowing the fluid in the chamber from a space below the at least one fluid passage apparatus, through the at least one fluid passage apparatus, to a space above the at least one fluid passage apparatus as the at least one fluid passage apparatus moves down in the chamber thereby controllably moving the tubular string down.

22. The method of claim 21 wherein the wellbore motion control apparatus further comprises the at least one piston including a first upper piston and a second lower piston, each movably disposed in the chamber, the first upper piston secured to the central mandrel so the central mandrel moves with the first upper piston, and the at least one fluid passage apparatus including at least one first fluid passage apparatus for the first upper piston and at least one second fluid passage apparatus for the second lower piston, the first upper piston movable about at least one rod connected to the second lower piston so that the first upper piston is movable downwardly on the at least one rod as fluid passes through the at least one first fluid passage to move to abut the second lower piston, fluid in the chamber flowable through the at least one first fluid passage apparatus at a first flow rate and through the at least one second fluid passage apparatus at a second flow rate, the first flow rate greater than the second flow rate, so that the central mandrel moves at the first flow rate and then moves thereafter at the second flow rate, the method further comprising moving the central mandrel at the first flow rate and then moving the central mandrel at the second flow rate.

23. The method of claim 22 wherein the first flow rate is such that the first upper piston is movable in response to weight of the wellbore motion control apparatus therebelow and the second upper piston is movable following abutment therewith of the first upper piston at a rate between ¼ inch and ½ inch per minute.

24. The method of claim 23 wherein the wellbore motion control apparatus further comprises re-set apparatus for re-setting the system in a wellbore, the method further comprising re-setting the wellbore motion control apparatus in the wellbore with the re-set apparatus.

25. The method of claim 24 wherein the wellbore motion control apparatus further comprises locking apparatus adjacent the central mandrel for releasably holding the central mandrel, the method further comprising selectively locking the central mandrel with the locking apparatus.

* * * * *